US005386981A

United States Patent [19]

Sugimoto et al.

[11] Patent Number: 5,386,981

[45] Date of Patent: Feb. 7, 1995

[54] AUTOMATIC PAPER PROCESSING METHOD AND CUT-SHEET FEED ROTARY PRESS HAVING AUTOMATIC PAPER PROCESSING APPARATUS

[75] Inventors: Seiji Sugimoto, Chiba; Takemasa Shibata, Tokyo; Yutaka Hitani, Kanagawa; Katsunori Kadokura, Chiba, all of Japan

[73] Assignee: Dainippon Ink & Chemicals, Inc., Tokyo, Japan

[21] Appl. No.: 992,966

[22] Filed: Dec. 11, 1992

[51] Int. Cl.[6] ..... B65H 5/22

[52] U.S. Cl. ..... 271/3.1; 198/576; 271/189; 271/214

[58] Field of Search ..... 271/189, 213, 214, 215, 271/217, 3.1; 414/794.4, 790.3, 790.7, 789.9, 417, 928, 903; 400/635, 636; 198/576, 832.1, 833

[56] References Cited

U.S. PATENT DOCUMENTS

| | | | |
|---|---|---|---|
| 3,308,750 | 9/1941 | Voegelin | 198/832.1 X |
| 3,403,622 | 10/1968 | Moser et al. | 198/832.1 X |
| 3,996,036 | 12/1976 | Strauss et al. | 198/832.1 X |
| 4,367,999 | 1/1983 | Benuzzi | 271/189 X |
| 4,423,995 | 1/1984 | Karis | 271/217 X |
| 4,708,564 | 11/1987 | Mylrea et al. | 414/903 X |
| 4,712,787 | 12/1987 | Princiotta, Sr. et al. | 271/217 X |
| 4,765,790 | 8/1988 | Besemann | 414/903 X |
| 4,897,018 | 1/1990 | Nakaoda et al. | 271/189 X |
| 5,013,211 | 5/1991 | Nakaoda et al. | 271/189 X |
| 5,014,974 | 5/1991 | Jones et al. | 271/189 |
| 5,102,117 | 4/1992 | Henn et al. | 271/189 |

FOREIGN PATENT DOCUMENTS

| | | | |
|---|---|---|---|
| 648585 | 9/1962 | Canada | 271/189 |
| 0432768 | 6/1991 | European Pat. Off. | 198/832.1 |
| 503811 | 6/1951 | France | 271/189 |
| 197802 | 7/1976 | France | 271/189 |
| 0175654 | 10/1982 | Japan | 271/189 |
| 0167445 | 9/1984 | Japan | 271/189 |
| 0171964 | 9/1985 | Japan | 271/217 |
| 194194 | 1/1964 | Sweden | 271/188 |

*Primary Examiner*—H. Grant Skaggs
*Assistant Examiner*—Carol Lynn Druzbicki
*Attorney, Agent, or Firm*—Armstrong, Westerman, Hattori, McLeland & Naughton

[57] ABSTRACT

A method and apparatus for processing printed paper in a cut-sheet feed rotary press comprising receiving printed sheets from a printing press on a receiving device at a paper discharge, one sheet at a time, and stacking such received sheets, one on the other, withdrawing and transferring the stacked sheets to a further processing station, the apparatus comprising a printing press having a paper discharge, a paper-receiving device at the paper discharge for receiving the discharged paper, and a conveyer for conveying the paper-receiving device with the discharged paper thereon, from the paper discharge to a further processing station for the discharge of paper therefrom and for returning the paper-receiving device to the paper discharge after the printed paper thereon have been discharged therefrom at the further processing station.

23 Claims, 25 Drawing Sheets

AUTOMATIC PAPER PROCESSING METHOD AND CUT-SHEET FEED ROTARY PRESS HAVING AUTOMATIC PAPER PROCESSING APPARATUS

BACKGROUND OF THE INVENTION

The present invention relates to an automatic paper processing method in a cut-sheet feed rotary press comprising an automatic paper feed unit, a printing unit composed of an ink feeder, a wet water feeder, a plate drum, a blanket drum and a press drum, and a paper discharge unit, and also relates to a cut-sheet feed rotary press having an automatic paper processing apparatus, which is constituted by adding an automatic paper processing apparatus to the aforementioned rotary press.

Heretofore, a method called "blanking" has been used in a paper discharge portion of a cut-sheet feed rotary press. That is, sheets after printing (hereinafter called "printed sheets") are not piled up straight but separated into groups by using boards and bridges, so that piling-up of printed sheets larger than a predetermined number is avoided to prevent ink from transferring to the back of paper. However, the blanking work is more difficult as the printing speed increases. Furthermore, the blanking work is harder as the print size increases. Therefore, a new system free from the blanking work is required.

In the case where the blanking work is carried out, the work of removing boards and bridges and then piling up printed sheets straight is required after ink is dried. This straight piling-up work includes various kinds of processing steps such as truing-up, inversion, powder removal, and so on. Furthermore, troublesome processes such as removed bridge carrying work, and so on, are required after completion of the straight piling-up work, so that automatization in after-processing of printed paper is prevented.

Furthermore, automatization in the whole of a press factory has been advocated for the double purpose of maintaining evenness of printing and filling up the shortage of human hands. Introduction of an automatic carriage has been discussed under the pressure of necessity for automating carrying of printing materials, above all, sheets before printing (hereinafter called "printing sheets", whereas printing sheets and printed sheets are generally called "sheets") and printed sheets, in the factory.

However, printed sheets must be subjected to various kinds of after-processing steps as described above. Furthermore, in most cases, printed sheets must be subjected to the press by many times for the purposes of multicolor printing, surface treatment, and so on. Accordingly, simply connecting the respective steps by the automatic carriage cannot provide practical use thereof because of the enormousness of the area occupied by carrying paths and the enormousness of the quantity of carrying of unarranged goods, that is, the enormousness of the number of automatic carriages required. Because the press in one of the city-type industries, it is, particularly, more difficult to secure a wide place as the area occupied by carrying paths increases. The provision of practical use thereof is prevented.

SUMMARY OF THE INVENTION

An object of the present invention is to provide an automatic paper processing method in which, not only printed sheets are selectively transferred to the next after-processing step directly from a paper discharge unit, but an outlet of printed sheets from the after-processing step is disposed in parallel to an inlet of a paper feeding unit of a printing press to thereby make the printed paper processing steps more rational, make the route of carrying of the automatic carriage very simple, make the area occupied by the carrying route small and make practical use thereof possible, and the provision of a cut-sheet feed rotary press having an automatic paper processing system.

In order to attain the above object, the present invention provides the following two constituent elements.

The first constituent element is that a predetermined number of printed sheets accumulated in a paper discharge portion of a body of a printing press are selectively transferred to the next after-processing step from the paper discharge portion.

The second constituent element is that a unit for the after-processing step is disposed in parallel to the printing press so that a printed paper outlet of the after-processing unit is disposed near to a paper feeding unit of the body of the printing press.

More in detail, according to an aspect of the present invention, the cut-sheet feed rotary press comprises: a printing press body section composed of a paper feeding unit, printing units and a paper discharge unit; a discharged paper transfer unit provided in the paper discharge unit portion; and a conveyer connected to the discharged paper transfer unit.

Furthermore, according to another aspect of the present invention, the cut-sheet feed rotary press comprises: a printing press body section composed of a paper feeding unit, printing units and a paper discharge unit; a paper transfer unit provided so as to be in contact with the paper feeding unit; a discharged paper transfer unit provided in the paper discharge unit portion; and a conveyer connected to the discharged paper transfer unit, by which all steps of from the paper feeding step to the printed paper after-processing step can be automated.

Furthermore, according to a further aspect of the present invention, the cut-sheet feed rotary press comprises: a printing press body section composed of a paper feeding unit, printing units and a paper discharge unit; a discharged paper transfer unit provided in the paper discharge unit portion; a conveyer connected to the discharged paper transfer unit; and at least one member selected from the group of a powder removing unit, a truing-up unit, an inverting unit and a straight piling-up unit and connected to the conveyer.

Furthermore, according to a still further aspect of the present invention, the cut-sheet feed rotary press comprises: a printing press body section composed of a paper feeding unit, printing units and a paper discharge unit; a paper transfer unit provided so as to be in contact with the paper feeding unit; a discharged paper transfer unit provided in the paper discharge unit portion; a conveyer connected to the discharged paper transfer unit; and at least one member selected from the group of a powder removing unit, a truing-up unit, an inverting unit and a straight piling-up unit and connected to the conveyer.

Alternatively, according to another aspect of the present invention, the cut-sheet feed rotary press comprises: a printing press body section composed of a paper feeding unit, printing units and a paper discharge unit; a paper transfer unit provided so as to be in contact with the paper feeding unit; a discharged paper transfer unit provided in the paper discharge unit portion; a conveyer connected to the discharged paper transfer unit; and at least one member selected from the group of a powder removing unit, a truing-up unit, an inverting unit and a straight piling-up unit and connected to the conveyer, in which at least one automatic paper carriage port is provided at an outlet of either of the paper transfer unit and the conveyer or at an outlet of any one of the powder removing unit, the truing-up unit, the inverting unit and the straight piling-up unit.

Alternatively, according to a further aspect of the present invention, the cut-sheet feed rotary press having an automatic paper processing apparatus, comprises: a printing press body section composed of a paper feeding unit, printing units and a paper discharge unit; a paper transfer unit provided so as to be in contact with the paper feeding unit; a discharge paper transfer unit provided in the paper discharge unit portion; a conveyer connected to the discharged paper transfer unit; and at least one member selected from the group of a powder removing unit, a truing-up unit, an inverting unit and a straight piling-up unit and connected to the conveyer, in which the paper feed site of the printing press is fitted to the outlet site of the conveyer or fitted to the outlet site of any one of the powder removing unit, the truing-up unit, the inverting unit and the straight piling-up unit.

That is, an inlet for printing paper and an outlet for printed paper are arranged in parallel to each other so that the carrying of printing paper and the carrying of printed paper by an automatic carriage can be made easily by the paper feed site carrying route of the printing press body. A multistage structure constituted by a plurality of conveyers used in the present invention may be used as a solid conveyer, so that the solid conveyer can be used as a drying conveyer for drying ink by slowly carrying printed paper on the multistage conveyer. In the case where quick drying ink is used, or in the case where ink can be dried quickly because of printing paper used, or in the case where ultraviolet drying is made by using ultraviolet hardening type ink, or in the case where electron beam drying or infrared drying is made, the conveyer can serve also as a storehouse for automatic semifinished goods to wait for the next process in timing.

DETAILED DESCRIPTION OF THE PREFERRED EMBODIMENT

Figure 1:
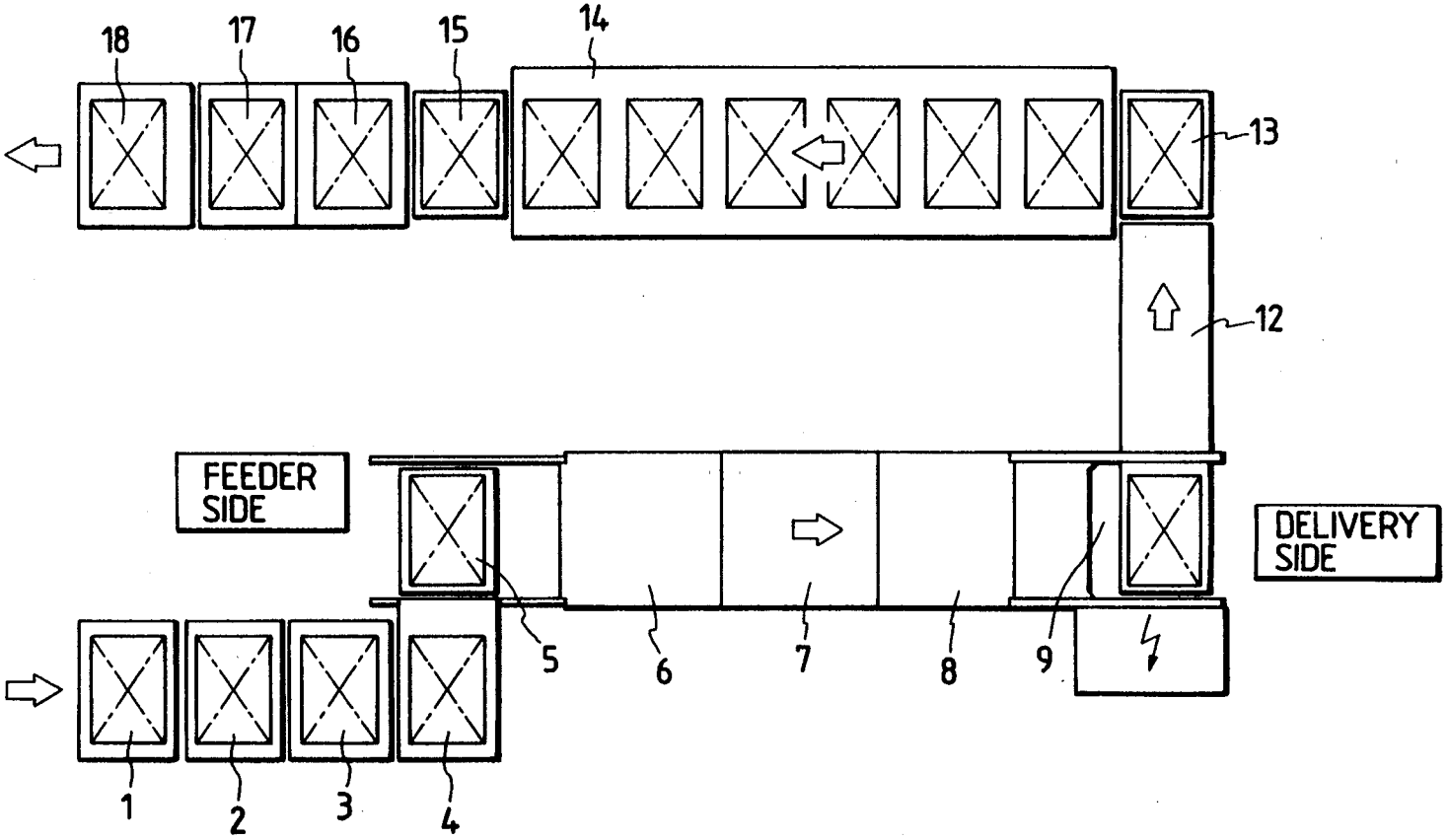
FIG. 1 is a plan view showing the arrangement of a cut-sheet feed rotary press having an automatic paper processing apparatus according to the present invention.

FIG. 1 is a plan view showing the arrangement of a printer as an embodiment of the present invention, which comprises a carry-in port 1 for carrying an automatic printing paper carriage in, a roller conveyer 2, a wasted paper feeder 3, a fed paper transfer 4, a paper feeder 5, printing units 6, 7 and 8, a paper discharge 9, a discharge paper transfer 12 provided as a part of the paper discharge 9 and for receiving a predetermined number of printing sheets and transferring the predetermined number of printing sheets in the direction perpendicular to the printer, an inlet-site elevator 13, a solid conveyer 14, an outlet-site elevator 15, a true-up 16, a pile-up 17, and a carry-out port 18.

The carry-in port 1 serves as a place where printing sheets carried by the automatic carriage are taken into the line of the printer as an embodiment of the present invention. The carry-in port 1 may be provided with a driving arm by which printing sheets piled up on a pallet on the automatic carriage can be transferred to the roller conveyer 2 (which is a section next to the carry-in port 1) together with the pallet.

The roller conveyer 2 serves to convey printing sheets to the wasted paper feeder 3 (which is a section next to the carry-in port 1). The roller conveyer 2 may be constituted by an available driving roller conveyer. It is preferable that either one of the carry-in port and the roller conveyer can be adjusted in height. This is because the level of the upper surface of the wasted paper feeder 3 (or the fed paper transfer 4 which will be described later) may be different from the level of a rack of the automatic carriage.

Figure 2:
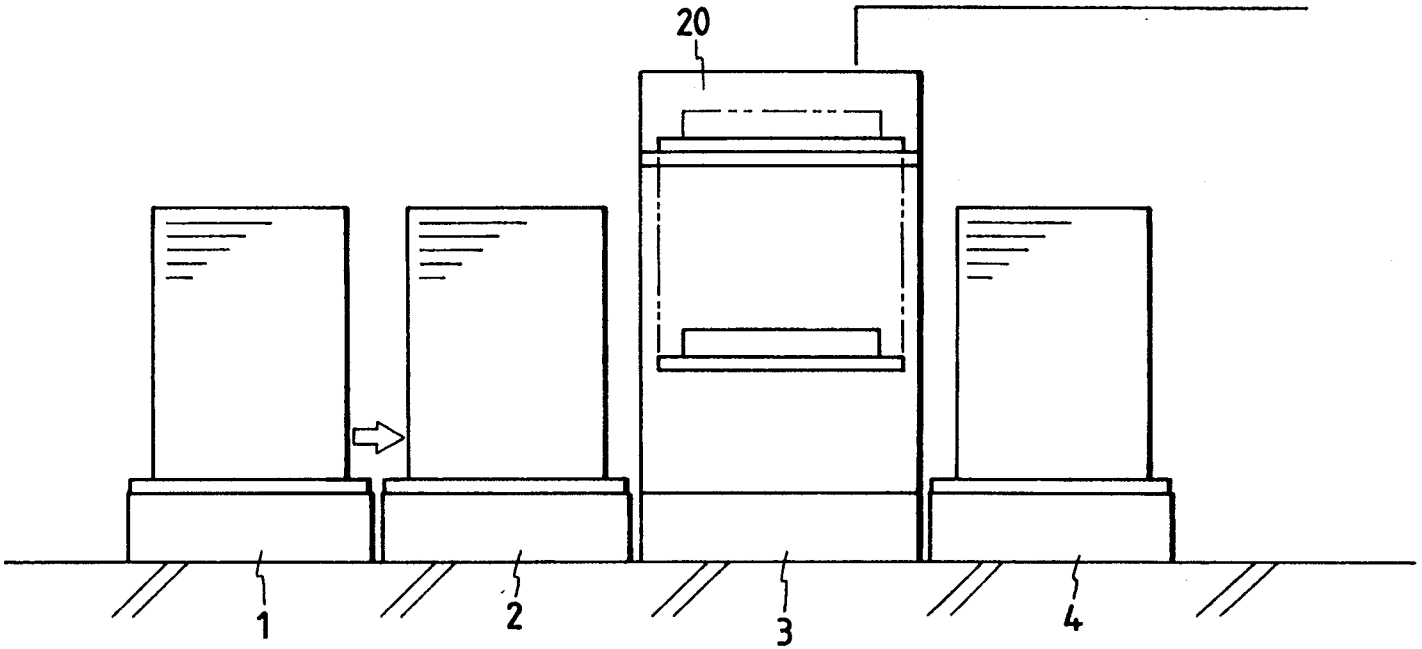
FIG. 2 is a side view showing the arrangement of the carry-in port, the roller conveyer, the wasted paper feeder and the fed paper transfer.

The term "wasted paper" used herein means paper to be used for trial printing to check the density or estimation of ink in an early stage of printing. This trial printing is necessary at the time of the starting of printing. The wasted paper feeder 3 is provided with a wasted paper container 20 at the upper portion thereof as shown in FIG. 2 and has a function of feeding the wasted paper onto the upper surface of printing paper carried in after measurement of a predetermined number of sheets.

As described above, feeding of wasted paper is made only at the time of the starting of printing, so that feeding of wasted paper is not made after normal printing is started.

The fed paper transfer 4 is a device for transferring printing sheets to the automatic paper feeder 5 perpendicularly. That is, the fed paper transfer 4 is a perpendicular transfer conveyer constituted by a driving roller conveyer by which printing sheets can be transferred perpendicularly.

The reason why the line of from the carry-in port to the fed paper transfer is provided at a side of the paper feeder 5 is as follows. A place (printer operating portion) where an operator can operate the printer is secured in front of the paper feeder so that the line can be linearly connected to the paper feeder when the printer operating portion is disposed at a side of the paper feeder 5.

The paper feeder 5, the printing units 6, 7 and 8 and the paper discharge 9 may be constituted by available devices. The substantial functions of the available devices can be used in the present invention but unnecessary portions may be removed or the structures of the devices may be partly changed so as to be suitable for the present invention.

The discharged paper transfer 12 has a temporary paper receiving mechanism by which printing sheets successively discharged are piled up till the number of the printing sheets, thus piled up, reaches a predetermined value. The temporary paper receiving mechanism has two belt boards 10 and 11 (shown in FIG. 3). When the predetermined number of printing sheets are piled up on one of the belt boards (hereinafter, the printing sheets piled up high being merely called "stack"), the belt board starts descending and at the same time the other belt board rapidly moves to a position where printing sheets are received and piled up. At this time, a belt constituting the upper surface of the belt board is slid under the stack of printing sheets while the horizontal component of the movement of the belt is zero relative to the stack of printing sheets. Accordingly, the printing sheets are never disordered. Then, the belt board on which the stack is placed descends and then moves to the solid conveyer site in which only the stack is transferred to the following inlet-site elevator 13.

The inlet-site elevator 13 has an air table and a pusher. When the inlet-site elevator carrying the stack stops at the height of a predetermined floor of the solid conveyer 14, the stack on the air table is transferred to the solid conveyer by the pusher, not shown. At this time, the speed of the belt surface of the solid conveyer and the moving speed of the stack, to be transferred to the conveyer, must be kept equal to each other to prevent the stack from shifting or tumbling.

The solid conveyer 14 has a frame approximately shaped like a rectangular parallelepiped, in which belt conveyers, having smooth surfaces, are provided hierarchically multistageously to be driven. Stacks are one by one transferred to the belt conveyers by the inlet-site elevator 13 in order of starting from the uppermost or lowermost belt conveyer. The running speed of the respective belt conveyer is synchronized with the moving speed of the stack so that the stack can be smoothly transferred from the inlet-site elevator to the belt conveyer and from the belt conveyer to the outlet-site elevator. If the surface speed of the respective belt conveyer does not coincide with the moving speed of the stack, the printing sheet directly touching the surface of the belt conveyer, at the lowermost portion of the stack, is wrinkled or broken. Filling up columns, in order of from the uppermost stage to the lowermost stage, or from the lowermost stage to the uppermost stage, is highest in efficiency of use of space in the transfer of stacks to belt conveyers, that is, longest in drying time. In the case where a conveyer in some stage is to be used continuously though the conveyer is full, the stack is transferred from the belt conveyer to the outlet-site transfer at the same time the stack is transferred from the inlet-site transfer to the belt conveyer. As described above, the transfer in the inlet site of the conveyer is synchronized with the transfer in the outlet site of the conveyer.

The outlet-site elevator 15, provided at the outlet of the solid conveyer 14, has function reverse to the function of the inlet-site elevator 13. That is, the outlet-site elevator 15 receives a stack from the solid conveyer and transfers the stack to the truing-up section 16 which is next to the solid conveyer. The outlet-site elevator has an air table structure.

The truing-up section 16 is a unit for removing print powder and truing up the respective sides of printed sheets to avoid trouble in the next work, such as rear surface printing, after-processing or the like. A known unit can be used as the truing-up section 16 by partly remodeling.

The straight piling-up unit 17 is a unit for piling up the stack of printed sheets thus trued up on a pallet to form a height suitable for the next work or for warehousing. The straight piling-up unit 17 has a pallet feeder by which pallets removed by the paper feeder of the printing press body are successively automatically fed for straight piling-up. The carry-out port 18 is a place where printed sheets thus straight piled up are transferred to the automatic carriage.

Figure 3:
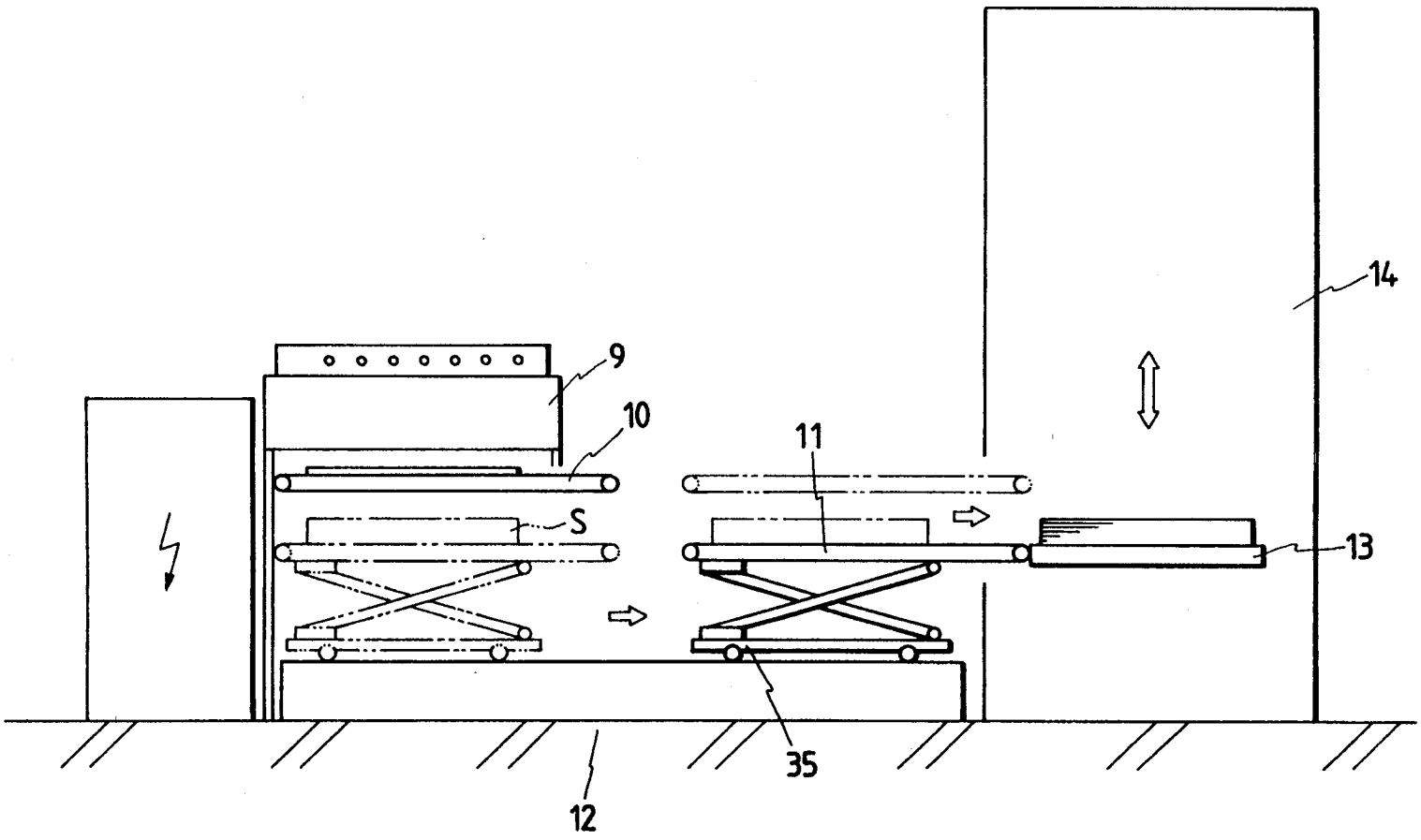
FIG. 3 is a side view showing the schematic arrangement of the discharged paper transfer.

The discharged paper transfer 12 will be described below in detail. FIG. 3 is a view showing the schematic arrangement of the discharged paper transfer 12 provided in the paper discharge 9 of the printing press body. The discharged paper transfer 12 comprises: two belt boards 10 and 11 for temporarily receiving printed sheets dropped from the paper discharge 9 and for moving the printed sheets; a running track 35 which moves a stack S to the adjacent inlet-site elevator 13 by moving itself horizontally after descending the belt board 10 to a running height while supporting the belt board 10 carrying the stack S when a predetermined number of printed sheets are piled up as the stack S on the belt board; and a driving unit 21 (shown in FIG. 4) for driving the running track to ascent the free belt board 11 from which the stack S has been transferred, put the belt board 11 on guide rails (not shown) and then move the belt board 11 on the guide rails to a position where the paper discharge 9 receives printed sheets temporarily.

Figure 4:
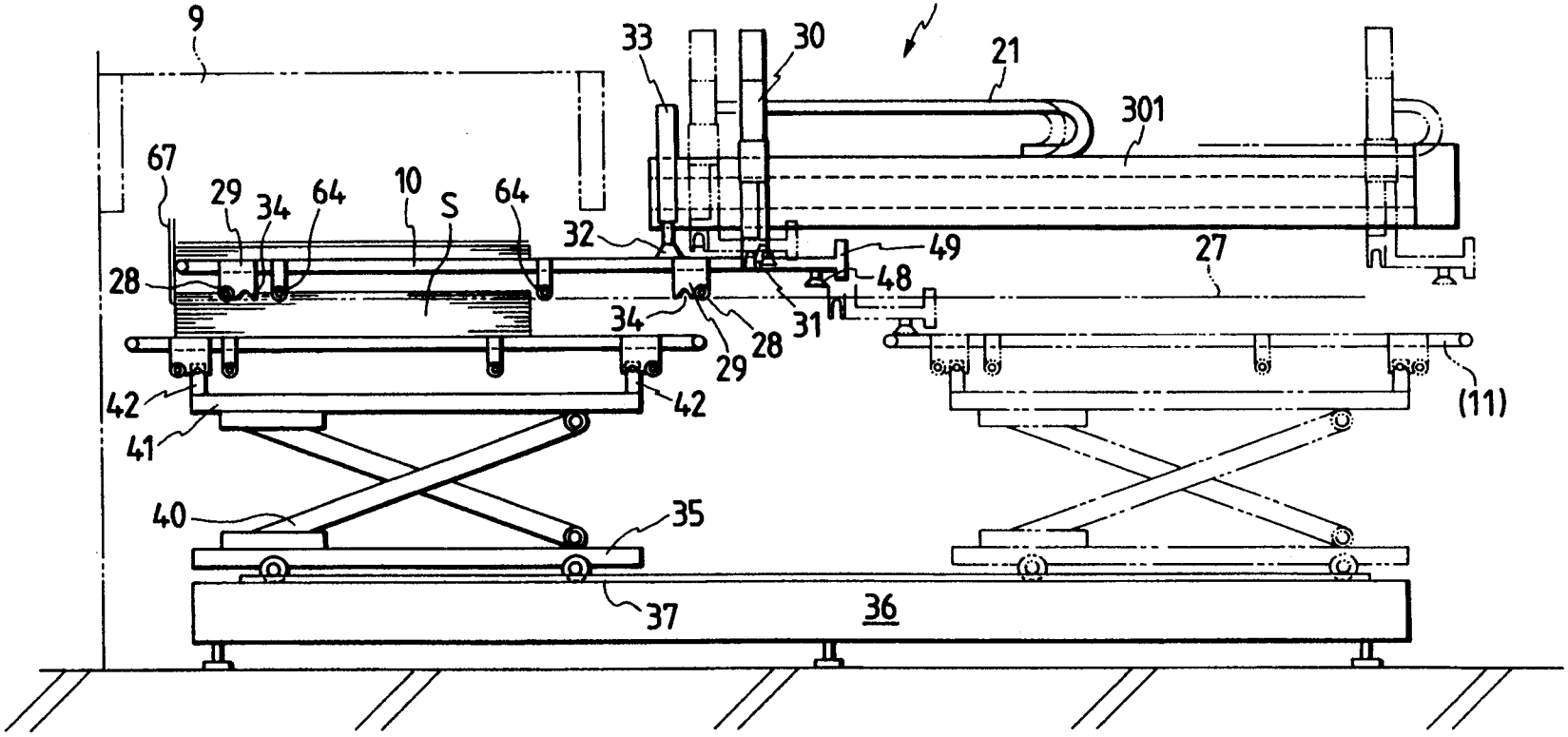
FIG. 4 is a side view showing the arrangement of the discharged paper transfer.
Figure 5:
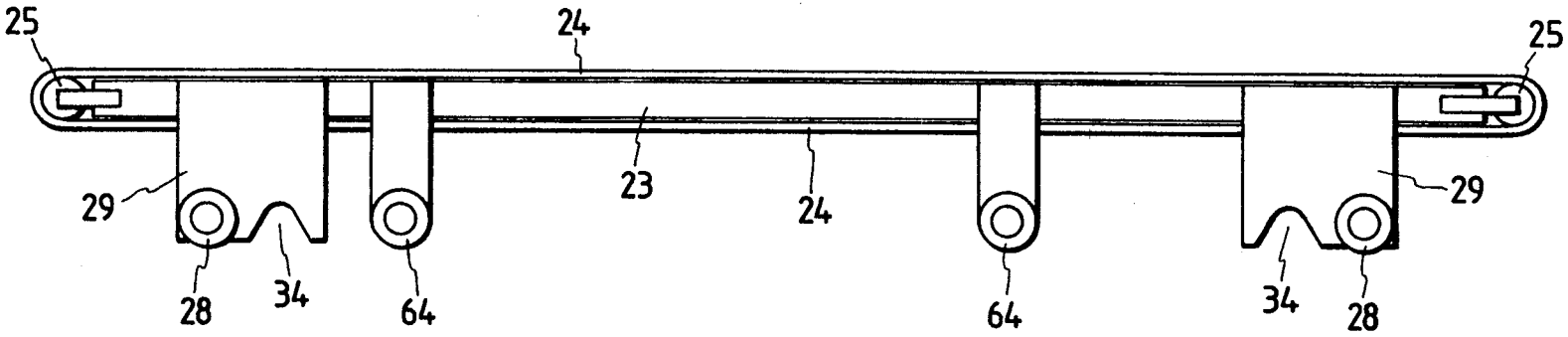
FIG. 5 is a side view of a belt board.
Figure 6:
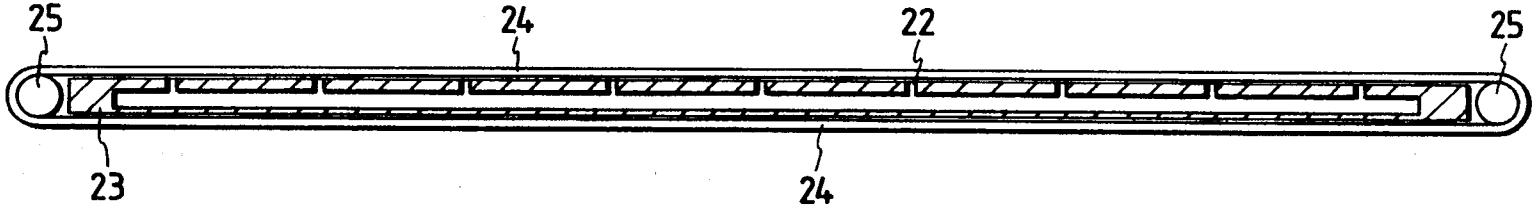
FIG. 6 is a sectional view of the belt board.

FIG. 4 is a view showing the detailed arrangement of the discharged paper transfer 12. The belt board 10 is put at a position where printed sheets are received. Accordingly, the belt board is not fixed so that it can move on guide rails 27 shown in two-dot-and-one-dash line. As shown in FIGS. 5 and 6, each of the belt boards 10 and 11 has an air table 23 provided with air blowing holes 22 at the upper surface thereof, and a flexible belt 24 wound on the upper and lower surfaces thereof so as to be slidable along the upper and lower surfaces of the air table. Rollers 25 (shown in FIG. 5) are provided at the forward and backward end portions of the air table so that the belt can slide easily. A side jogger 67, FIG. 4, fulfills a role of truing up the respective sides of printed sheets. In the drawing, the condition in which printed sheets are piled up to a height of the order of several centimeters is shown. That is, the side jogger 67 is lowered sufficiently so that the side thereof is brought into contact with the belt board 10 to thereby prevent the lower portion of the thus piled-up printed sheets from dropping from between the side jogger 67 and the belt board 10. If the belt 24 can slide lightly, the air table 23 may be replaced by a flat box.

In the position shown in FIG. 4, the belt board 10 is supported on the guide rails 27 slightly downward the opposite sides of the belt boards by a plurality of guide rollers 28 and 64 provided at the edge thereof and by a guide roller mount block 29, so that the posture thereof is maintained. A driving unit 21 for moving the belt board 10 along the guide rails is provided above the guide rails 27 extending to the right in FIG. 4. The driving unit 21 comprises: a pusher 30 for pushing the belt board to the left by engaging with shaft ends of the rollers 25 (shown in FIG. 5) projecting at the opposite end portions of the belt board 10; a pusher guide 301 for guiding the pusher; and a driving motor (not shown) for moving the pusher 30 along the pusher guide 301. A fork 31, engaged with the shaft ends of the rollers 25, is provided at the lower end of the pusher 30. A plurality of air cylinders 33, each having a suction member 32 for fixing the belt at the upper portion of the air table, are provided at the left end portion of the pusher guide 301. The operation of the air cylinders 33 will be described in the later description of the operation of the discharged paper transfer. In FIG. 4, the belt board 11 is put in a position where the belt board 11 is lowered while carrying the stack S of printed sheets.

The running track 35 is arranged so that it can be made to run on a running track base 36 by a driving unit (not shown) through wheels 37. An engagement convex portion 42 engaged with an engagement concave portion 34 of the block 29 of the belt board 10 is provided on a receiving stage 41, so that the belt board 10 is ascended or descended by the running track 35 in the condition in which the engagement concave and convex portions are engaged with each other.

Figure 7:
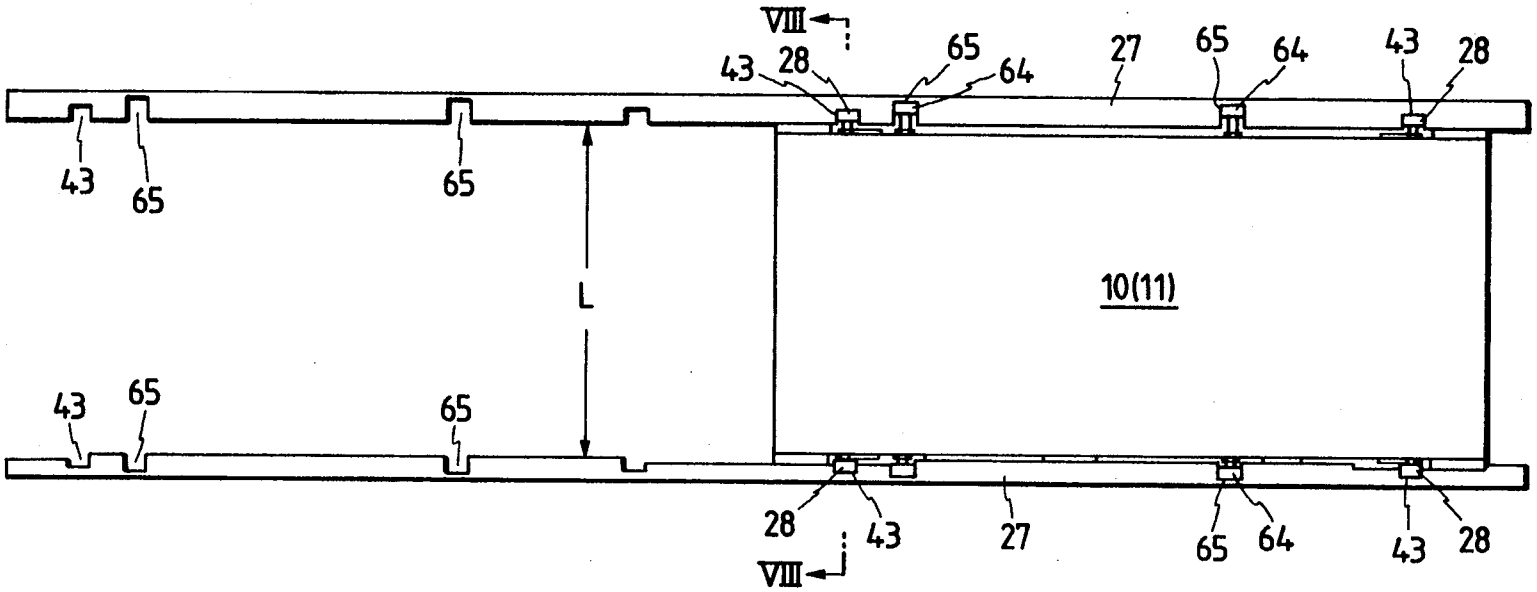
FIG. 7 is a side view of the guide rails.
Figure 8:
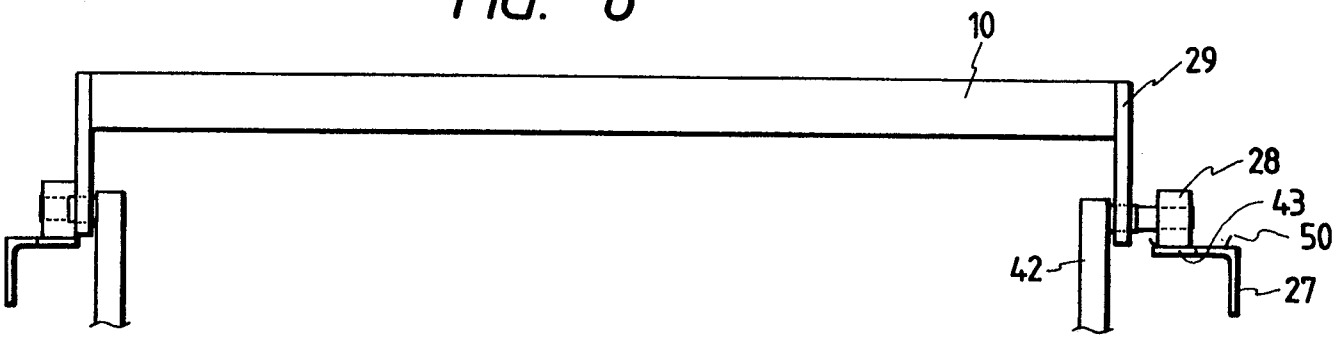
FIG. 8 is a sectional view taken along the line VIII—VIII in FIG. 7.

The relation between the guide rails 27 and the belt board 10 (or 11) will be described below with reference to FIGS. 7 and 8. In the pair of guide rails 27 set in parallel to each other in an internal size L larger than the width of the belt board 10, two sets of notches 43 and 65 (each set having four notches) are provided so that the guide rollers 28 and 64 provided in the sides of the belt board can pass through the notches upward and downward. One set (in the right in FIG. 7) is used for ascending the belt board 10 from the lower side of the guide rails to put the belt board 10 on the guide rails, and the other set (in the left) is used for descending the belt board 10 from the guide rails. FIG. 8 is a sectional view taken along the line VIII—VIII in FIG. 7, showing the condition in which the guide rollers 28 pass through the notches 43. Guide roller 64 similarly pass through the notches 65, FIG. 7. If the belt board 10, in this condition, is then moved slightly in the left in FIG. 7, the belt board 10 is put on the guide rails 27 while it is kept stable. The guide rollers 28 and 64 are, respectively limited by roller side guides 50, FIG. 8, so that the guide rollers, 28 and 64, never fall off.

Figure 9:
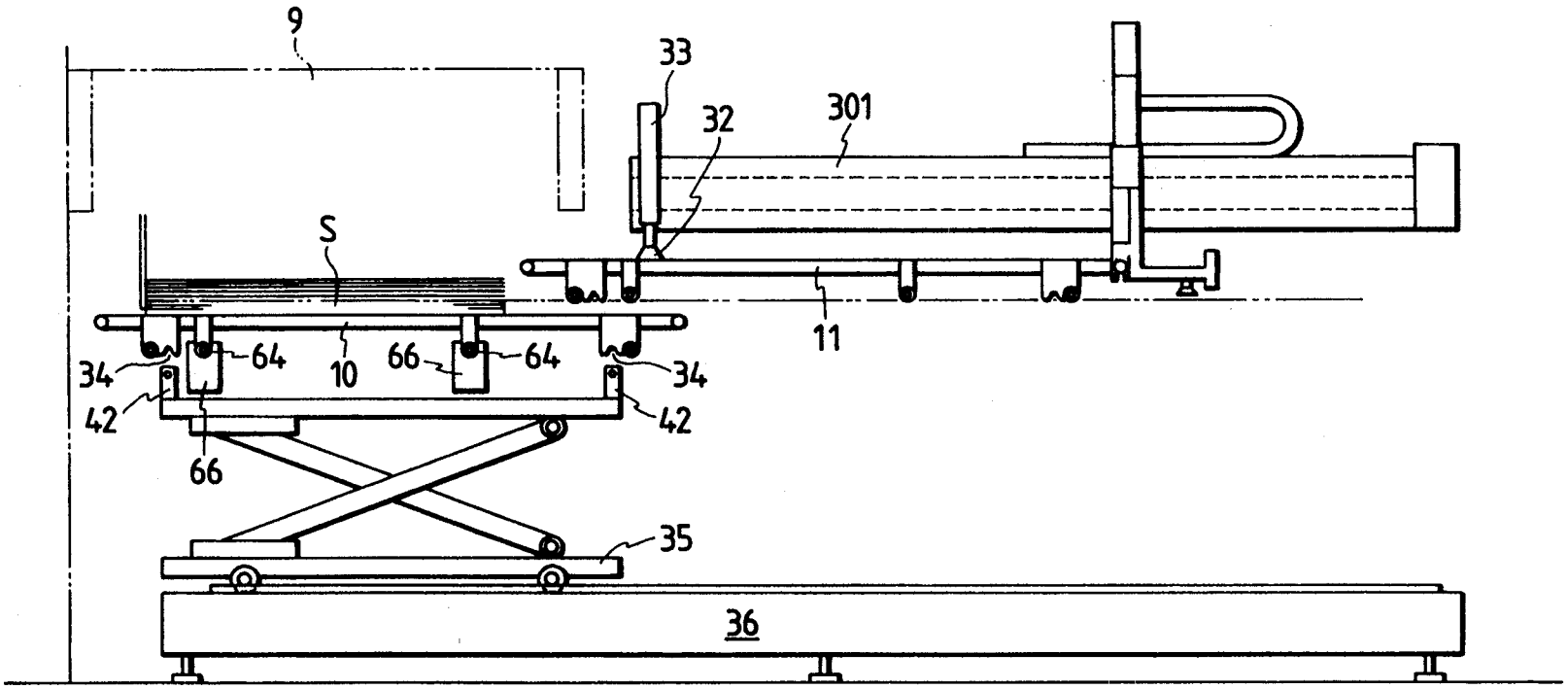
FIG. 9 is a view for explaining the operation of the discharged paper transfer.

The operation of the discharged paper transfer 12 will be described below with reference to FIGS. 9 through 19. In FIG. 9, a predetermined number of printed sheets are piled up on the upper surface of the belt board 10 to thereby form a stack S. Before this condition is obtained, the belt board 10 descends slowly with the operation of the paper discharge of the printing press while it is supported by a board holder 66 descending at a constant speed corresponding to the paper discharge speed. The next belt board 11 is in a standing-by position for entering into a printed paper receiving position. The air cylinder 33, for fixing the belt of the belt board 11, operates so that the suction member 32 fixes the belt by suction.

Figure 10:
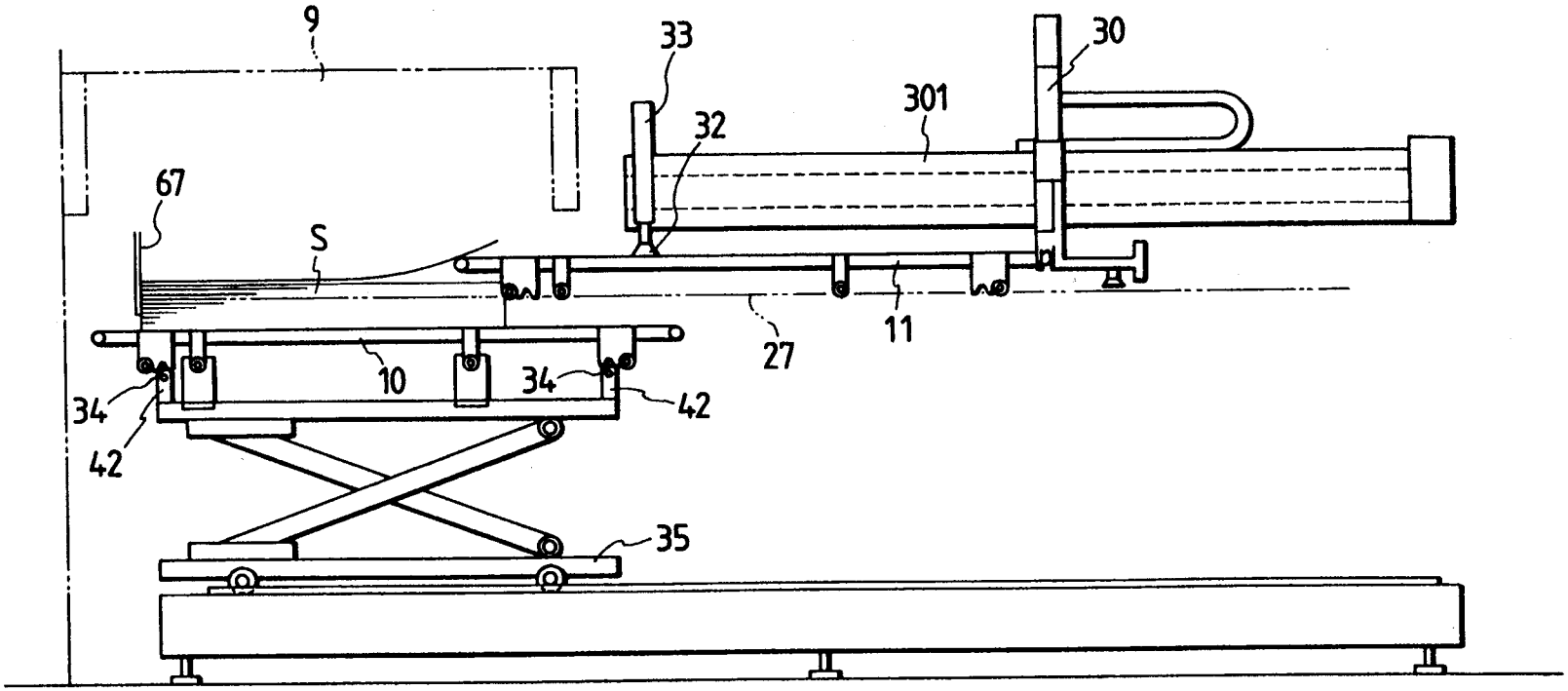
FIG. 10 is a view for explaining the operation of the discharged paper transfer.
Figure 11:
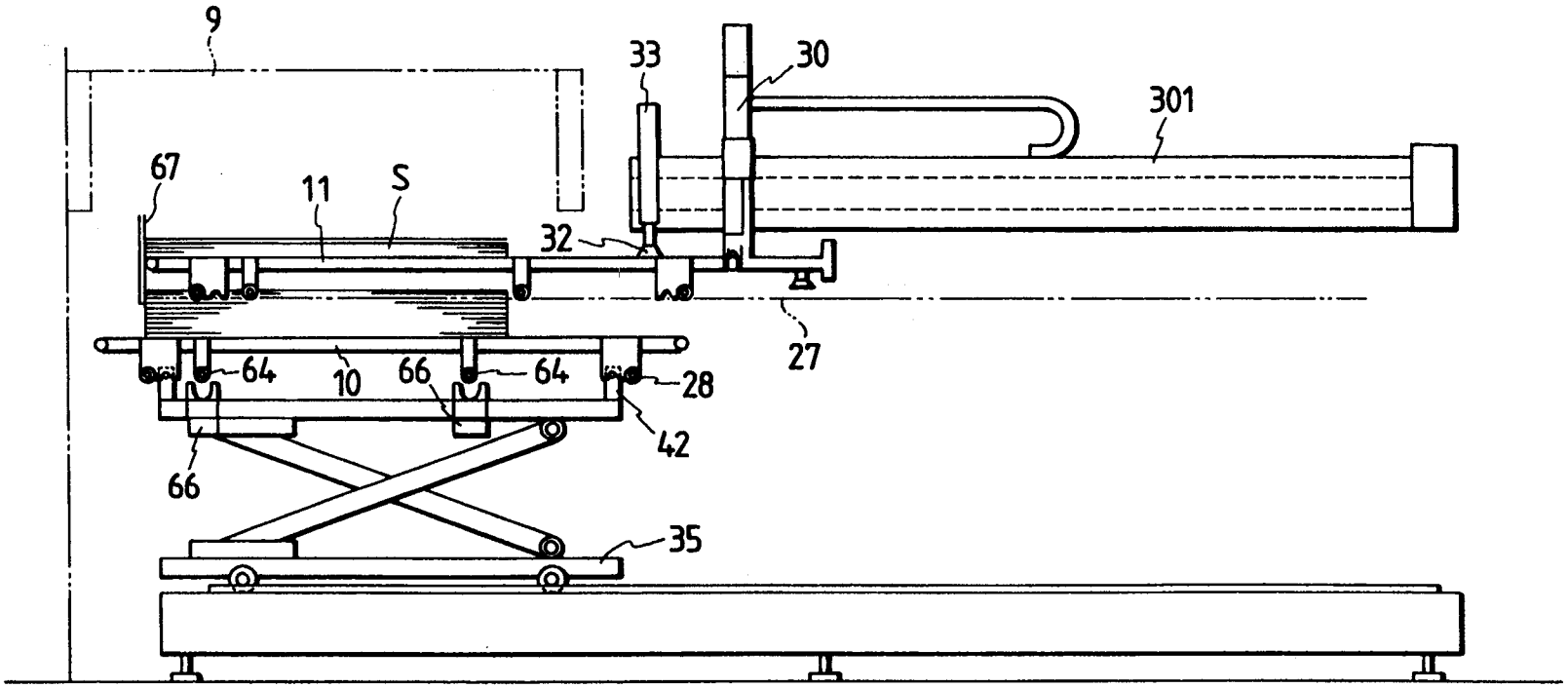
FIG. 11 is a view for explaining the operation of the discharged paper transfer.
Figure 12:
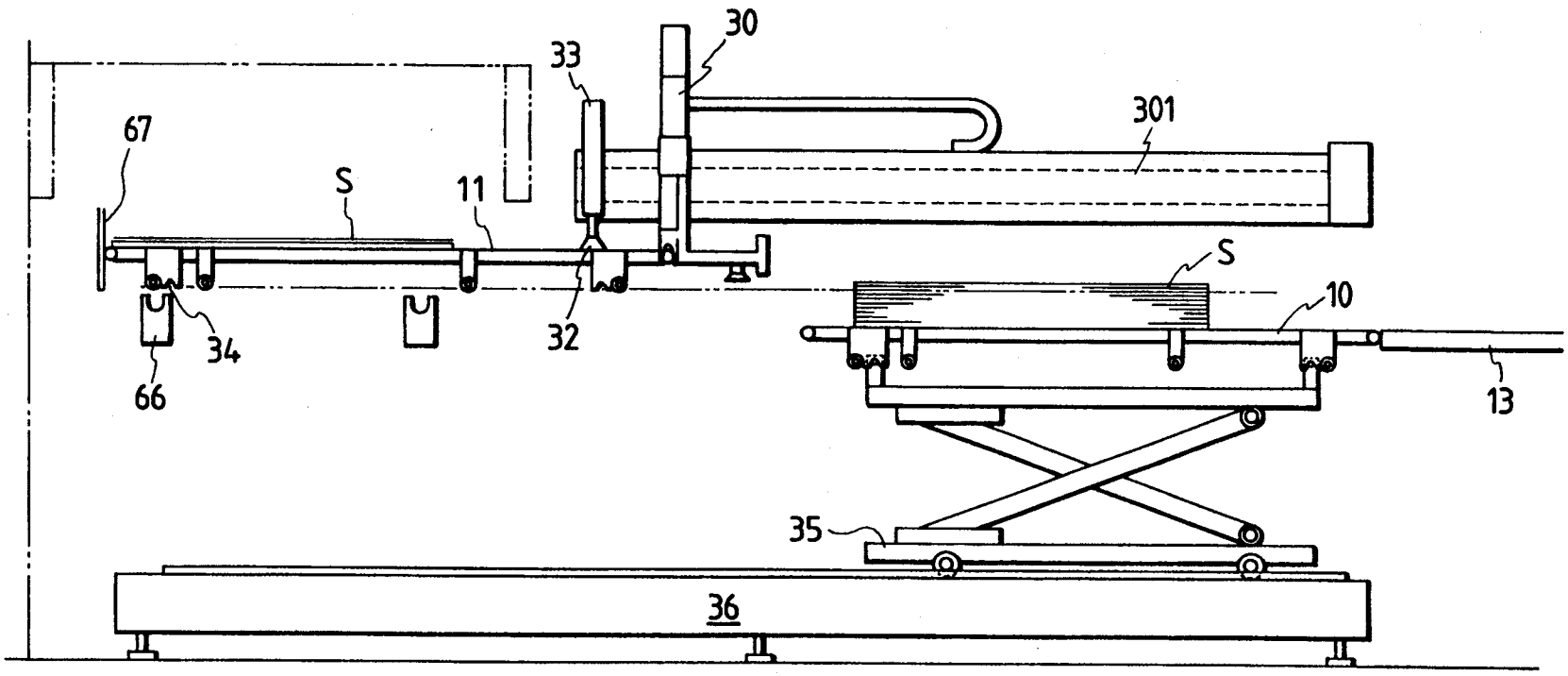
FIG. 12 is a view for explaining the operation of the discharged paper transfer.

FIG. 10 shows the condition in which the next belt board 11 is pushed by the pusher 30 and starts entering into the printed paper receiving position. In this condition, the engagement convex portion 42 of the elevator track is engaged with the engagement concave portion 34 of the belt board, so that the belt board 10 begins to be supported by the running track 35. FIG. 11 shows the condition in which the belt board 11 is moved to the printed paper receiving position and starts receiving the printed sheets. On the other hand, the board holder 66 connected to the paper discharge of the printing press to operate with the paper discharge descends continuously, so that it is perfectly separated from the guide roller 64. Accordingly, the belt board 10 is placed to a height where running by the running track is started. FIG. 12 shows the condition in which the running track 35 runs while carrying the belt board 10 and the stack S, so that the stack S reaches a position where the stack S is to be put on the next unit. Further, FIG. 12 shows the condition in which the position of the air cylinder 33 is kept in the operative position.

Figure 13:
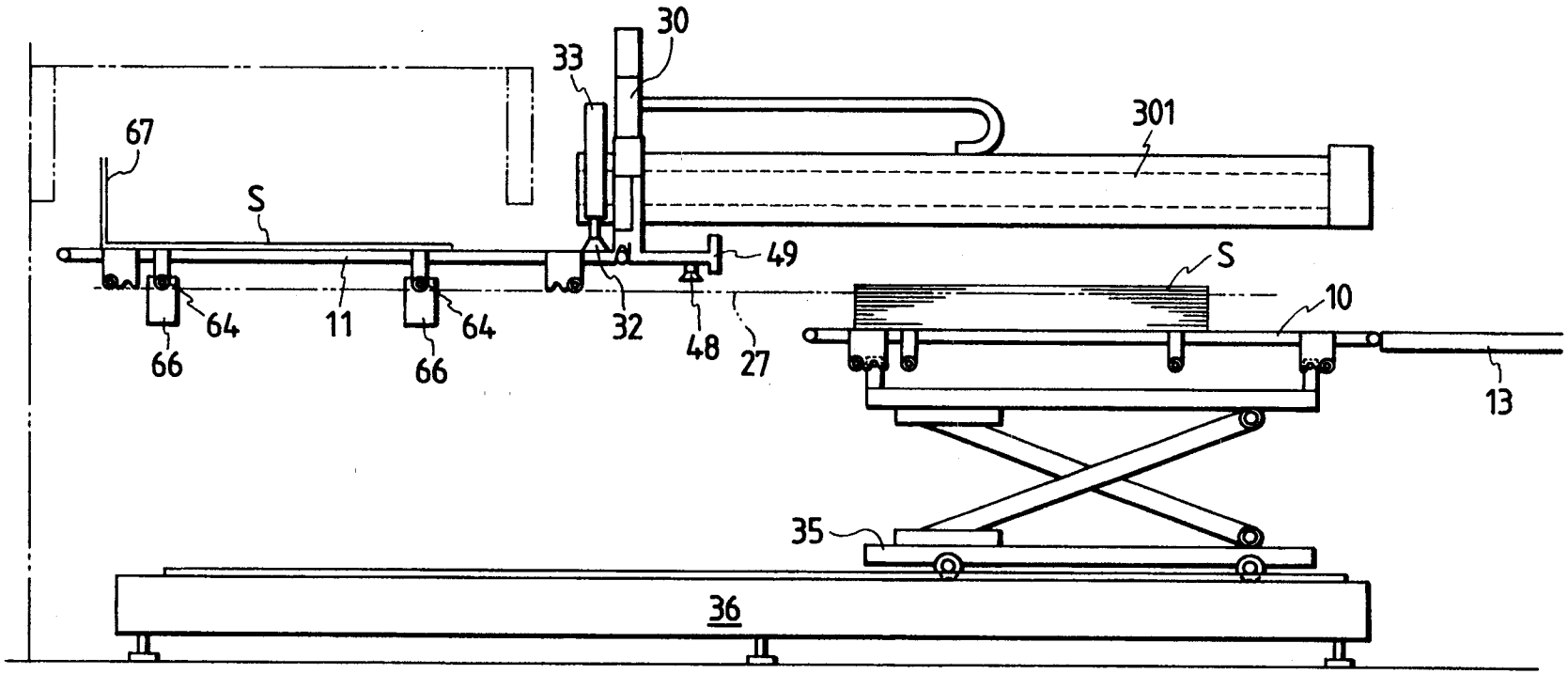
FIG. 13 is a view for explaining the operation of the discharged paper transfer.
Figure 14:
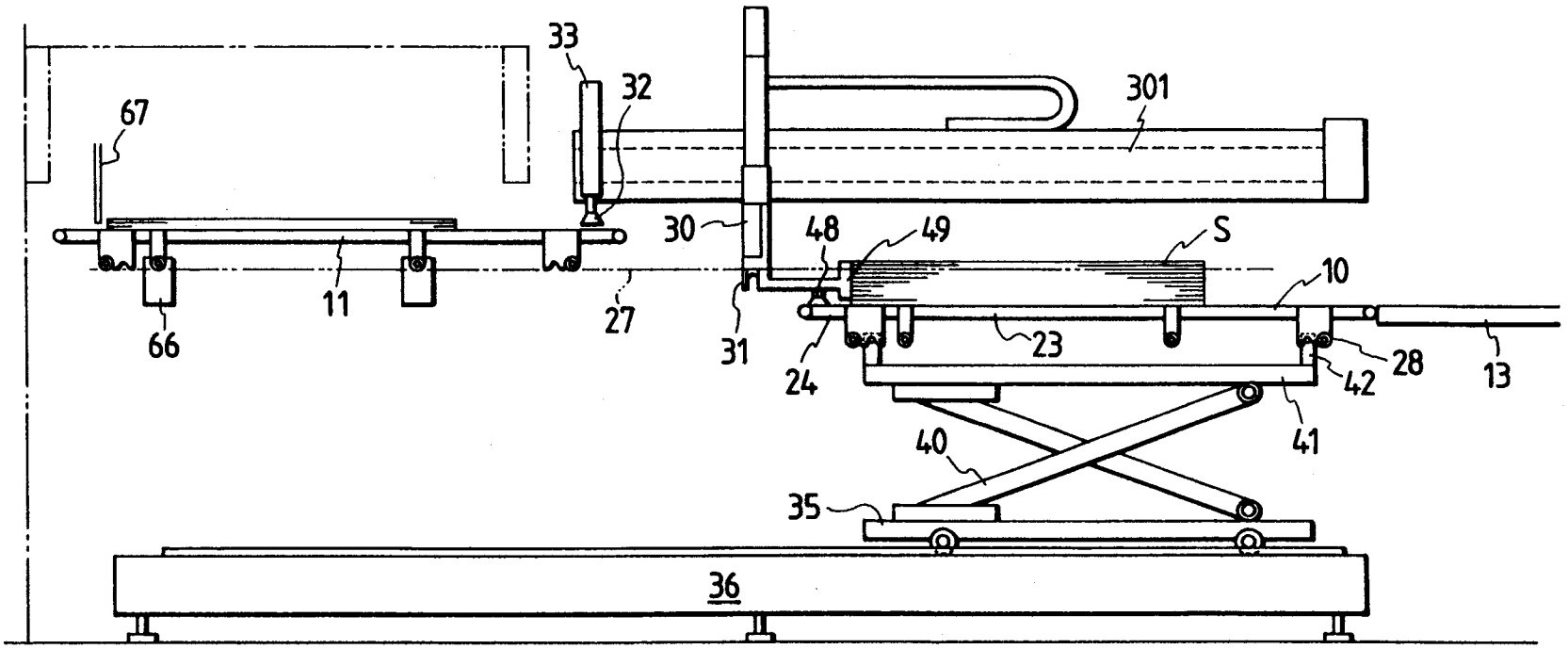
FIG. 14 is a view for explaining the operation of the discharged paper transfer.

FIG. 13 shows the condition in which the belt board 11 is moved left by operating the pusher 30 after removing the side jogger 67 to the upper portion, so that the belt board 11 is moved to a position where it can be disconnected from the guide rails 27 and can descend. In this condition, the belt board 11 is supported by the board holders 66. Thereafter, as shown in FIG. 14, the pusher 30 having a suction member 48 and a paper feed pusher 49 at the lower end is disconnected from the belt board 11 and moved to the backward end of the belt board 10. The suction member 48 contacts the belt 24, so that the paper feed pusher 49 touches the back portion of the stack S and starts to transfer the stack S of printed sheets to the inlet-site elevator 13 which is the next station. At this time, the air table 23 of the belt board 10 is fixed, and the belt 24 is turned by the pusher 30 and the sucker suction member 48 so that only the stack on the belt 24 is transferred. At this time, the suction member 32 is disengaged.

Figure 15:
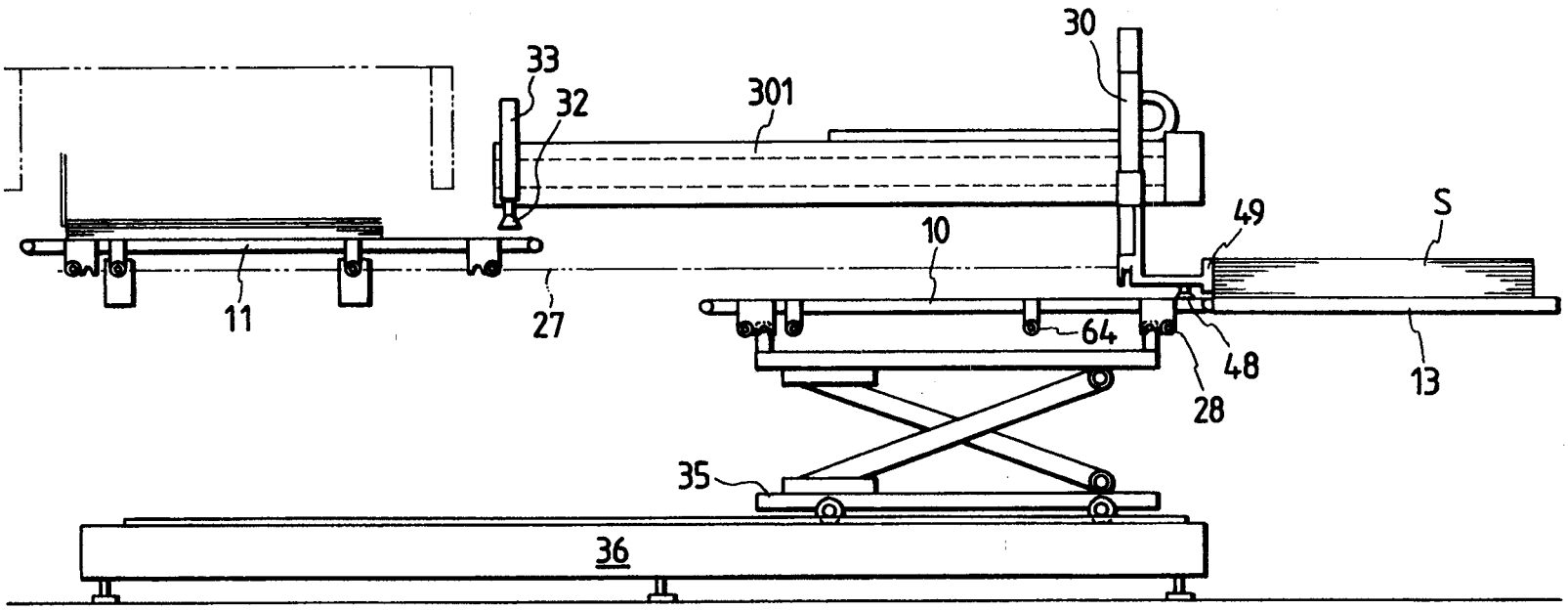
FIG. 15 is a view for explaining the operation of the discharged paper transfer.
Figure 16:
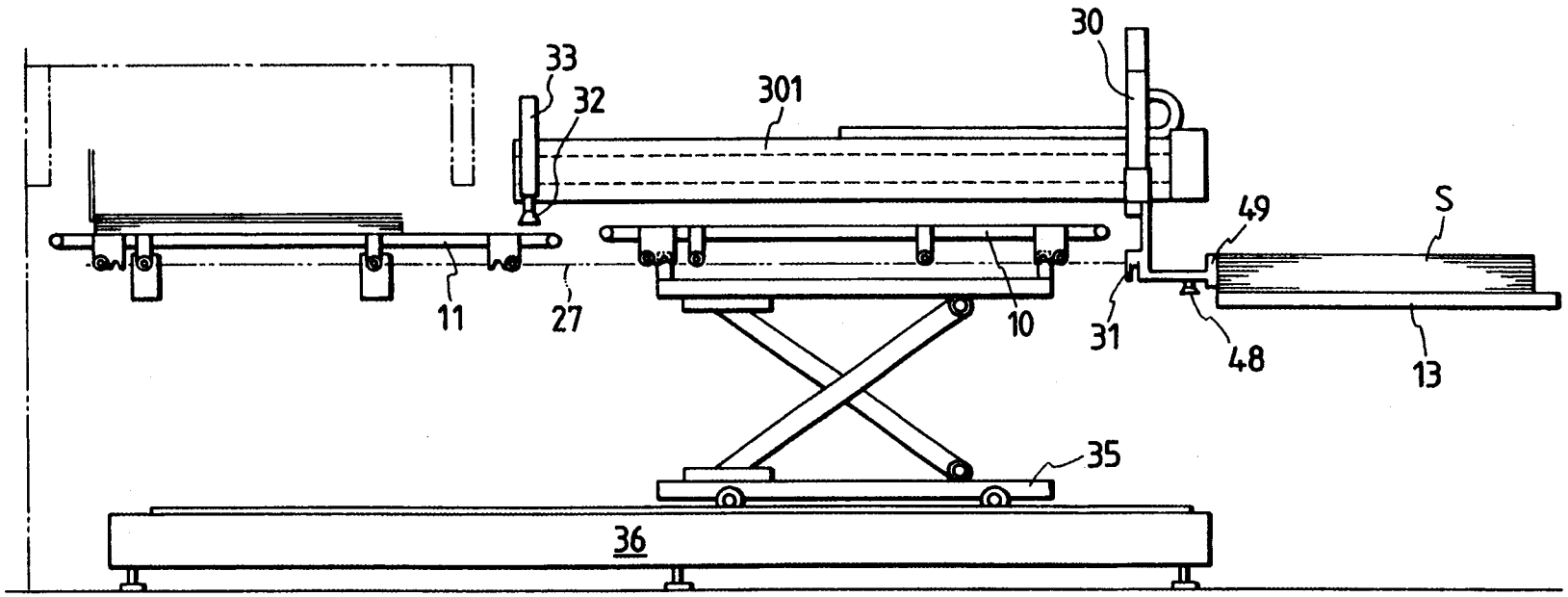
FIG. 16 is a view for explaining the operation of the discharged paper transfer.
Figure 17:
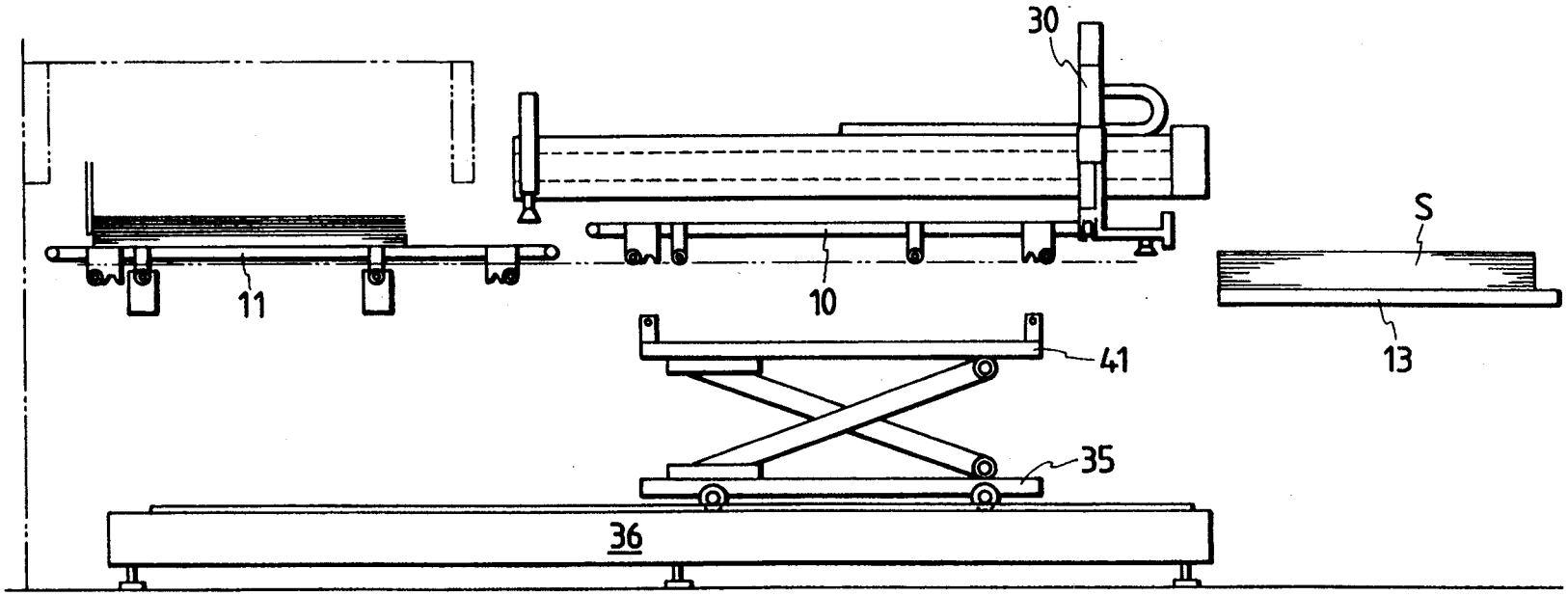
FIG. 17 is a view for explaining the operation of the discharged paper transfer.
Figure 18:
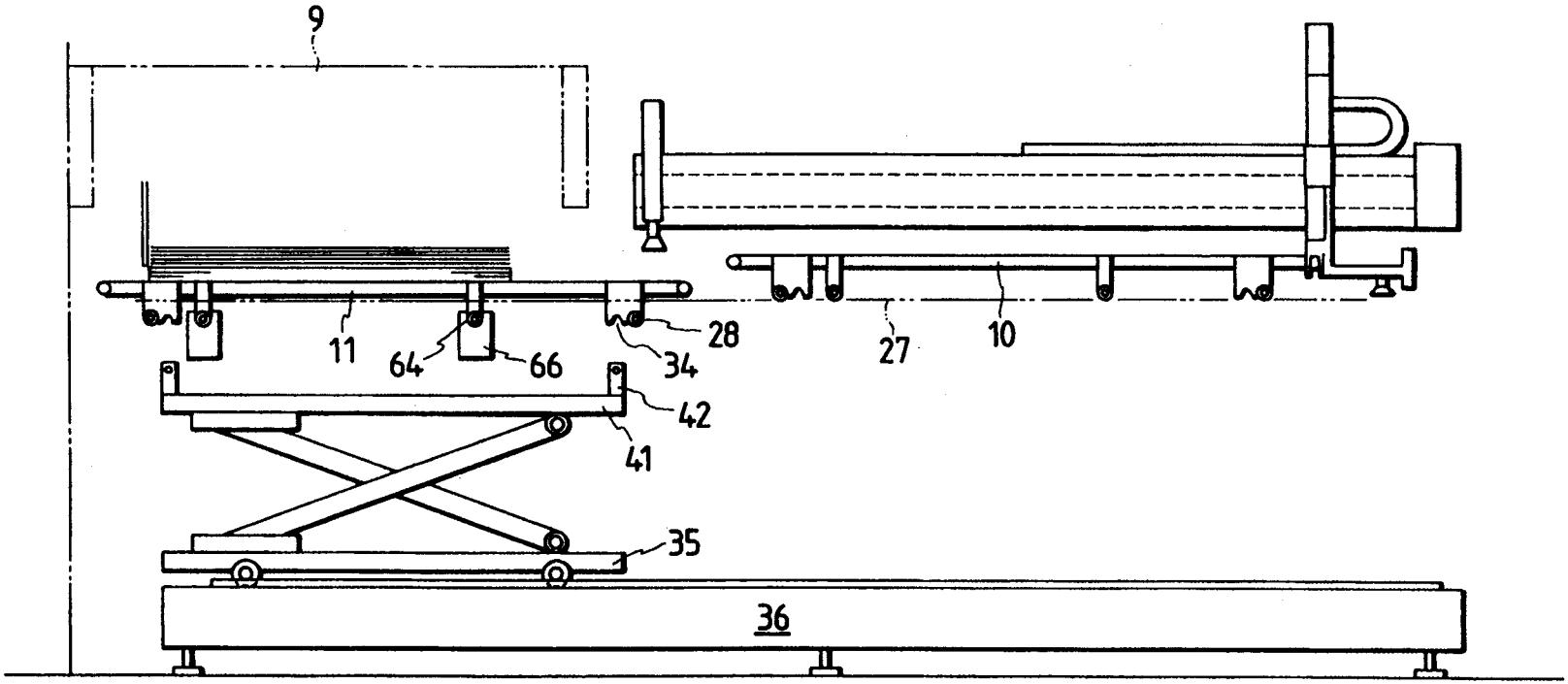
FIG. 18 is a view for explaining the operation of the discharged paper transfer.
Figure 19:
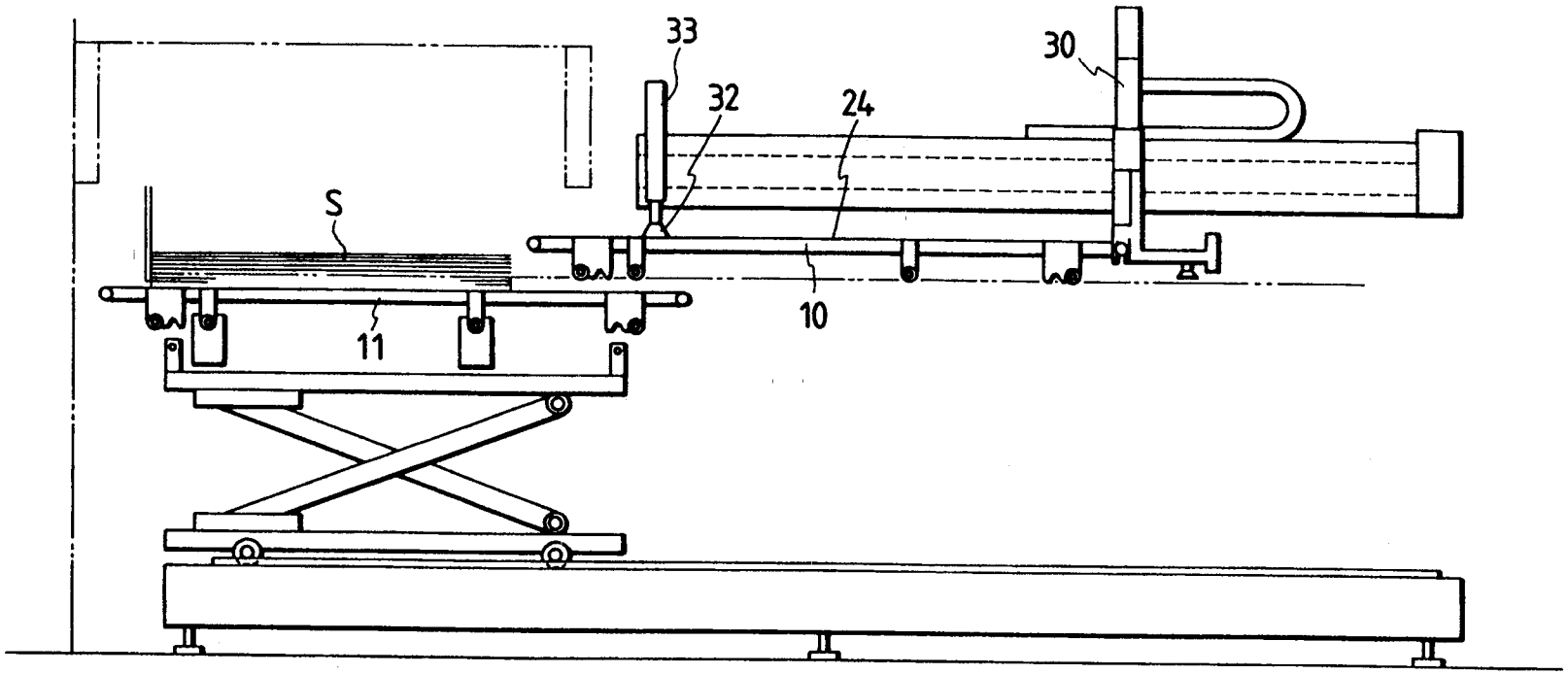
FIG. 19 is a view for explaining the operation of the discharged paper transfer.

FIG. 15 shows the condition in which the stack S is transferred to a predetermined position of the inlet-site elevator 13 by the pusher 30. FIG. 16 shows the condition in which the belt board 10 is put on the guide rails 27 by retreating the running track 35 from the condition of FIG. 15 to the left slightly, raising the free belt board 10, making the guide rollers 28 and 64, FIG. 15, pass through the notches 43 and 65, FIG. 7, of the guide rails 27 represented by the two-dot-and-one-dash line and then moving the guide rollers 28 and 64. FIG. 17 shows the condition in which the pusher 30 is engaged with the belt board 10 by lowering the receiving stage 41 of the running track. FIG. 18 shows the condition the running track 35 runs to a position where the belt board 11 is to be received. FIG. 19 shows the condition in which the suction member 32 and air cylinder 33 fix the belt 24 of the belt board 10 by suction, so that the pusher 30 starts forcing the belt board 10 to the printed paper receiving position.

Figure 20:
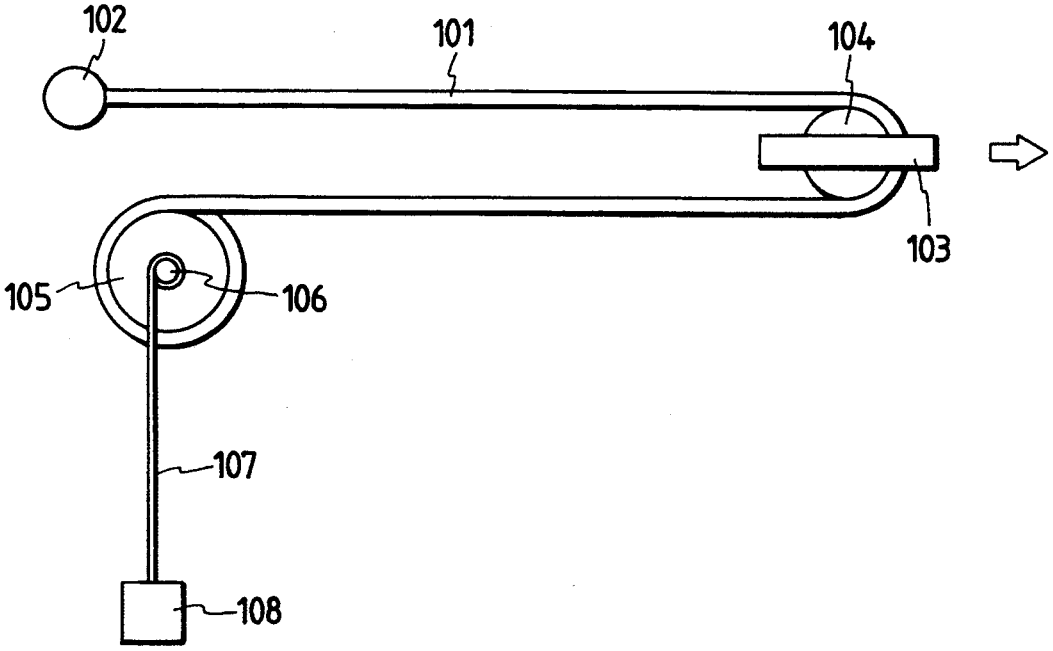
FIG. 20 is a view for explaining the principle of the present invention.

The reason why printed sheets, which successively fall down, can be temporarily received by the belt board without disorder will be theoretically described below. In FIG. 20, a belt 101 is laid on an end of a freely rotatable roller 104 mounted to a roller mount frame 103 after the belt 101 is fixed at a fixing portion 102. Then, the other end of the belt 101 is laid on a belt take-up roller 105. A wire take-up roller 106 is provided coaxially with the belt take-up roller 105. A weight 108 is attached to the forward end of a wire 107 wound on the wire take-up roller 106. The weight 108 gives rotating force to the belt take-up roller 105 to continuously pull the belt 101. Accordingly, the belt 101 is pulled toward the belt take-up roller 105 by a constant force.

In the drawing, when the freely rotatable roller 104 is moved in the direction of the arrow by a driving means (not shown), the belt 101 is expanded in the direction of the arrow but the straight line portion of the belt 101 between the belt fixing portion 102 and thus freely rotatable roller 104 is always stationary in the upward, downward, leftward and rightward directions, that is, always stationary relative to other fixing members. In other words, the horizontal component of the speed in the upper, straight line portion of the belt 101 is zero though the belt 101 is expanded. The same condition is provided in the case where the freely rotatable roller 104 moves in a direction reverse to the direction of the arrow, that is, the belt 101 is contracted. Even in the case where the freely rotatable roller 104 moves horizontally while sheet-like matter, such as printed sheets, is put on the upper surface of the belt 101 having the aforementioned property, the printed sheets are not influenced by horizontal force at all so that there is no change in position of the printed sheets. The same condition as described above is provided in the case where the moving speed of the freely rotatable roller 104 is changed.

FIGS. 21 through 24 show another embodiment of the discharged paper transfer which is effective for the case where printed paper is thin and lacks firmness. In this embodiment, belt boards 200 and 201, as described in the previous embodiment, and a belt board 202, having a auxiliary function, are provided so that either of the belt boards 200 and 201 and the belt board 202 are made to enter into the printed paper receiving position from both sides to thereby temporarily receive the printed sheets 204 which fall down successively to form the stack S.

Figure 21:
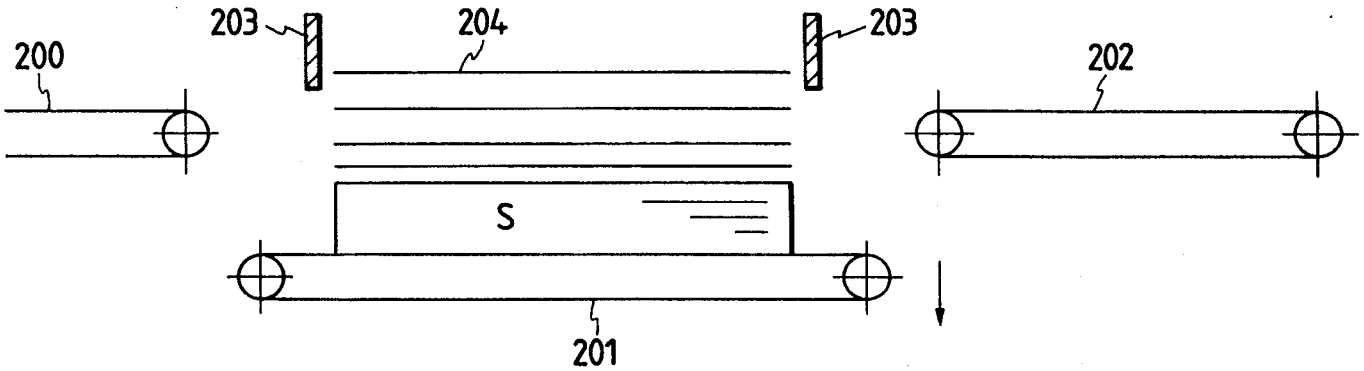
FIG. 21 is a view for explaining the operation of a further embodiment of the discharged paper transfer.

In FIG. 21, the belt board 201 is lowered while carrying the stack S of printed sheets thereon, whereas the belt boards 200 and 202 starts entering into the position where the printed sheets 204 descend. A paper receiving means 203, for temporarily supporting both sides of descending printed sheets are provided so as to be rotatable, so that the forward end of the belt board entering is prevented from colliding with the descending printed sheets. The paper receiving means 203 are rotated by an actuator, such as a motor or an electromagnetic solenoid (not shown) driven on the basis of reception of an electric or mechanical signal from the printing press body. It is preferable that suction members for attracting the printed sheets be provided on the upper surface of the paper receiving means 203 so as to be controllable.

Figure 22:
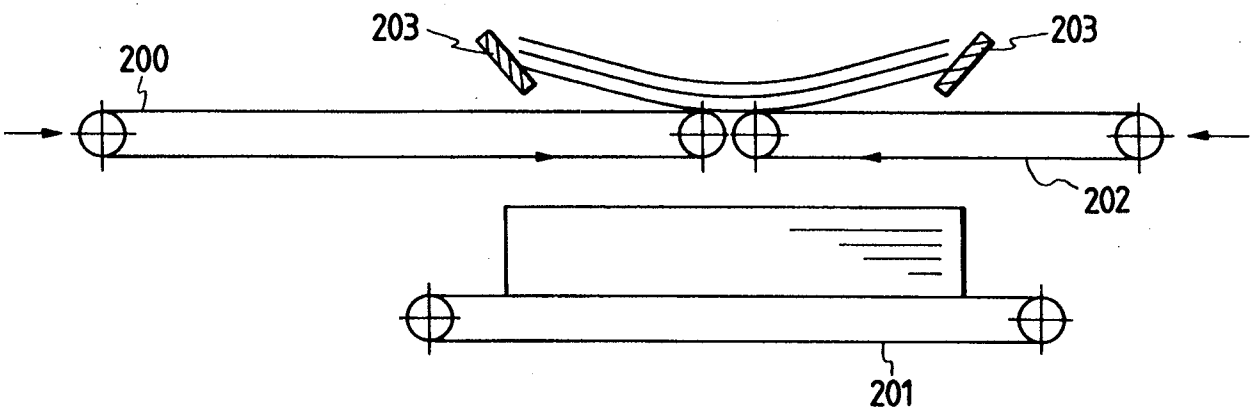
FIG. 22 is a view for explaining the operation of a further embodiment of the discharged paper transfer.

FIG. 22 shows the condition in which the belt boards 200 and 202 reach predetermined positions while the paper receiving means 203 retains several printed sheets. The belt boards 200 and 201 have the same structure and function as that of the belt boards 10 and 11. The belt board 202 moving horizontally may be smaller than the other belt boards.

Figure 23:
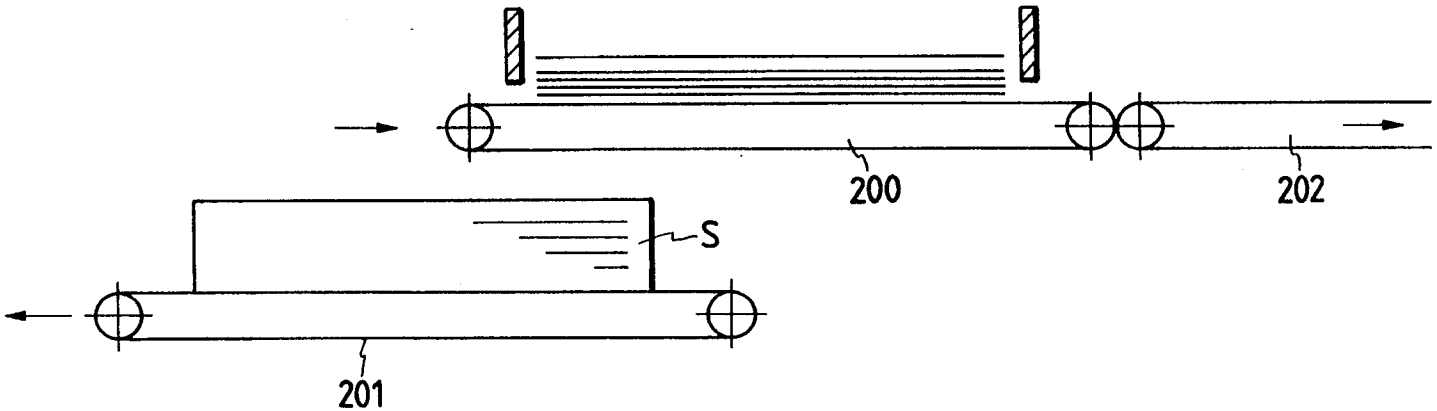
FIG. 23 is a view for explaining the operation of a further embodiment of the discharged paper transfer.

In FIG. 23, the belt board 202 is shunted, the belt board 200 is placed in the printed paper receiving position, and the belt board 201 carrying the stack S of printed sheets, is transferred to the next step unit by the running track, not shown.

Figure 24:
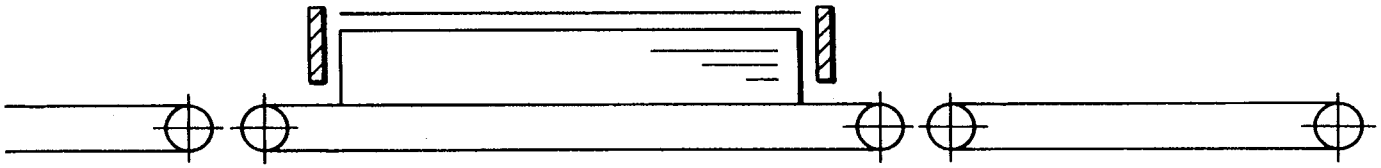
FIG. 24 is a view for explaining the operation of a further embodiment of the discharged paper transfer.

FIG. 24 shows the condition in which a predetermined number of printed sheets are perfectly piled up on the belt board 200 so that the condition is just before the situation goes to the next step shown in FIG. 21.

Figure 25:
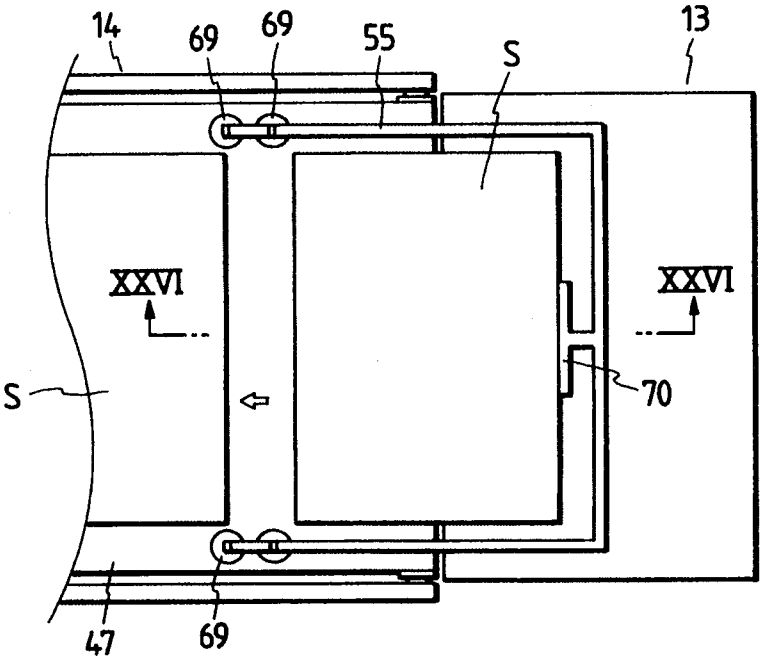
FIG. 25 is a plan view of the inlet-site elevator.
Figure 26:
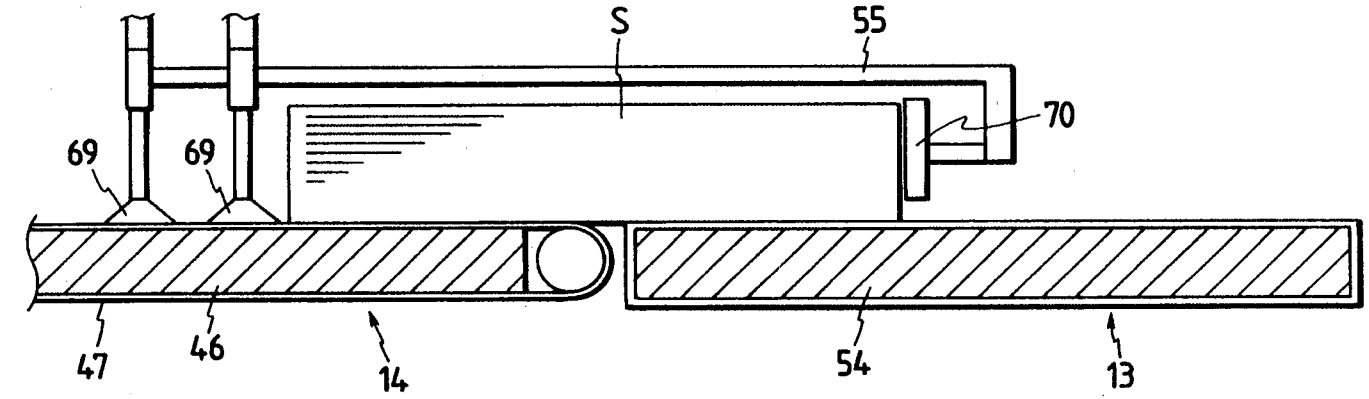
FIG. 26 is a sectional view taken along the line XXVI—XXVI in FIG. 25.
Figure 27:
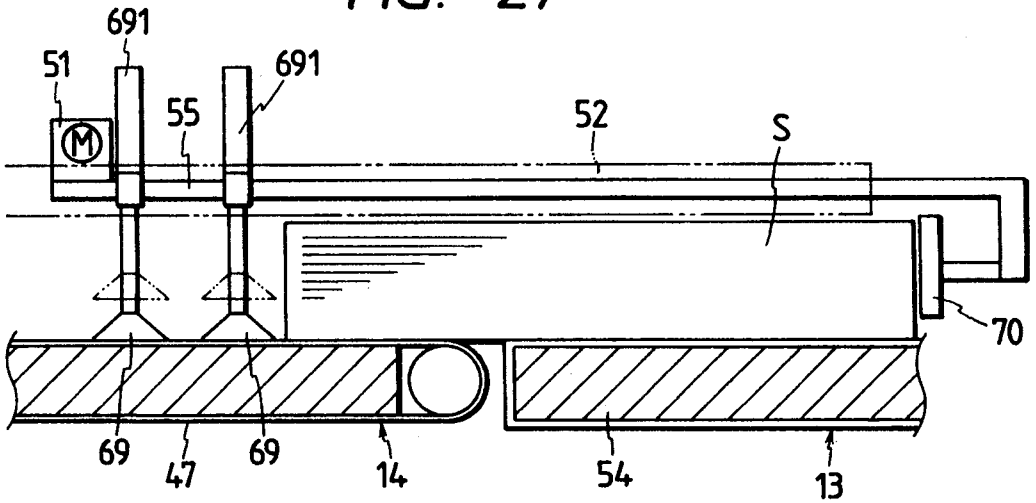
FIG. 27 is a view showing a sucker driving system of the inlet-site elevator.

FIG. 25 is a partly outaway plan view showing an example of the apparatus for transferring the stack S of printed sheets from the inlet-site elevator 13 onto the belt 47 of the solid conveyer 14 at a speed synchronized with the running speed of the belt. FIG. 26 is a sectional view taken along the line XXVI—XXVI in FIG. 25. FIGS. 25 and 26 show the condition in which the stack S is transferred from the air table 54 of the inlet-site elevator 13 to the belt conveyer of the solid conveyer 14. FIGS. 25 and 26 further show a plurality of suction members 69 for engaging the belt 47 of the solid conveyer, a suction member mount arm 55 and a pusher 70 connected to the arm to press the stack S from the back. FIG. 27 shows a system for driving the suction members 69. The system comprises air cylinders 691 for moving the suction member 69 up and down, a suction member mount arm 55, a pusher 70, guide rails 52 for guiding the running of the suction member mount arm 55, and a motor 51 for driving suction members 69 and the associated elements along the guide rails 52.

In the transfer of the stack S from the inlet-site elevator 13 to the solid conveyer 14 in the apparatus shown, the suction members 69, air cylinders 691, sucker arm 55, pusher 70, and so on are returned by the motor 51 so that the pusher 70 reaches the backward position (right in the drawing) of the stack S. Then, the suction members 69 are lowered to the surface of the belt 47 of the solid conveyer by the air cylinders 691 so that the suction members 69 engage the belt 47. At the same time the belt 47 starts running, the pusher 70 connected to the suction member mount arm 55 transfers the stack S from the inlet-site elevator to the solid conveyer. In the inlet-site elevator 13, the stack S can be moved by a smaller amount of force because the stack S is on air table 54.

Figure 28:
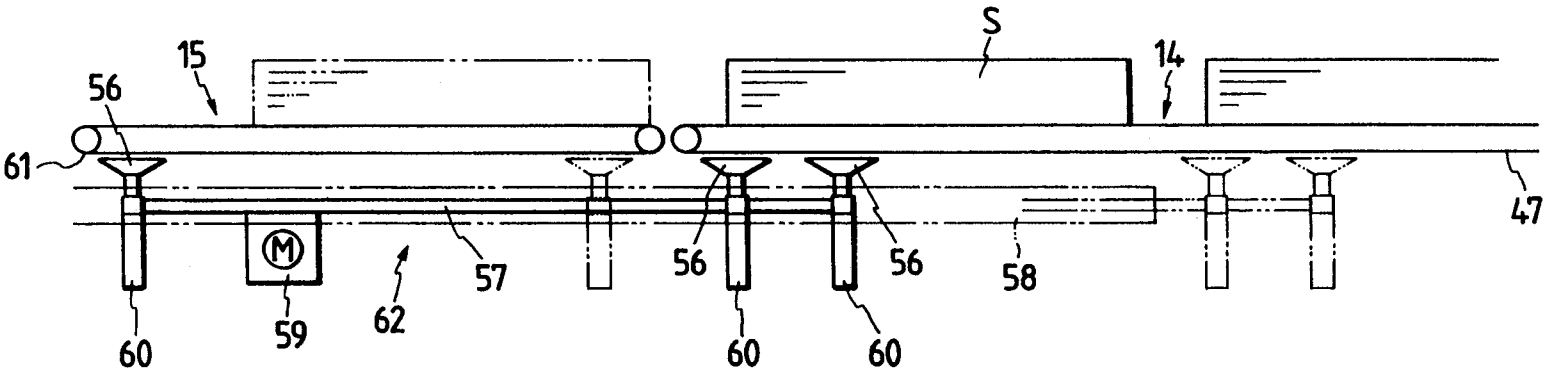
FIG. 28 is a view showing a conveyer driving system.

FIG. 28 shows an example of the driving system 62 for driving the belt of the solid conveyer 14. This driving system 62 comprises suction members 56, a suction member mount arm 57 for moving the suction members mounted thereon, a motor 59 for driving the belt driving system, guide rails 58 for guiding the mount arm 57 to move the mount arm 57 in conjunction with the motor 59, and air cylinders 60 for moving the suction members 56 between the engaged position and the open position. The belt driving system 62 serves to drive the belt 47 of the solid conveyer 14 and, at the same time, drive the belt 61 of the outlet-site elevator 15, synchronously. In the belt driving system 62, constructed as described above, the running speed of the belt 47 of the solid conveyer can be made to coincide with the running speed of the belt 61 of the outlet-site elevator. Accordingly, the stack S can be transferred from the solid conveyer to the outlet-site elevator without occurrence of crumbling or wrinkling.

Figure 29:
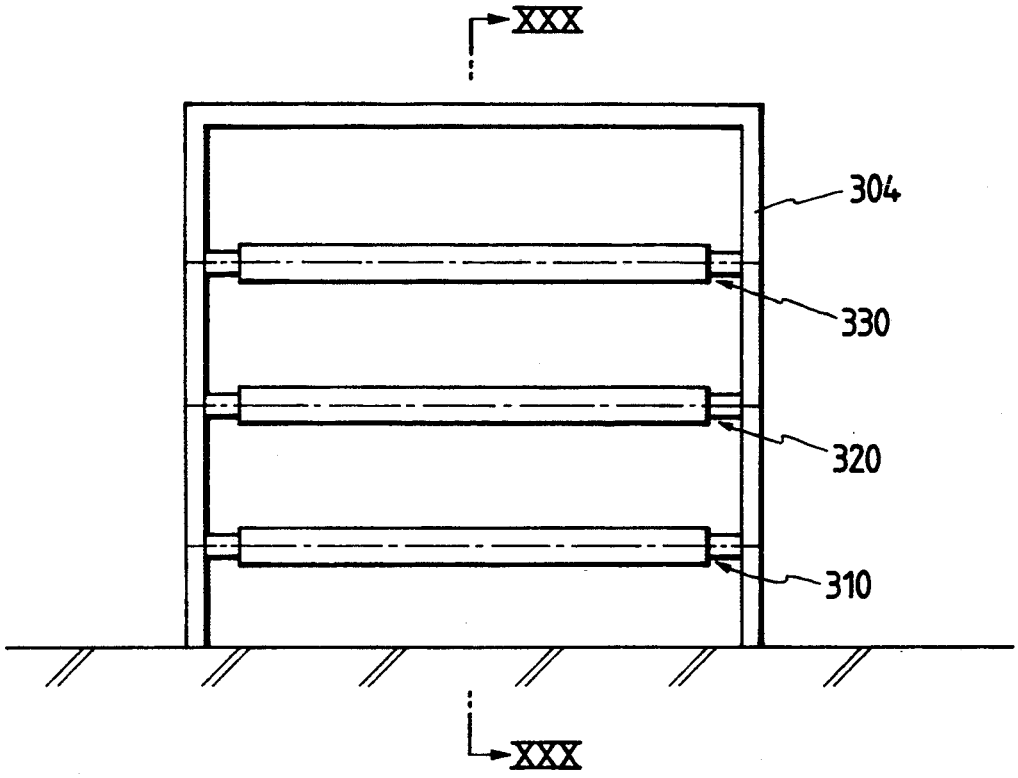
FIG. 29 is a front view of the solid belt conveyer as an embodiment of the present invention.
Figure 30:
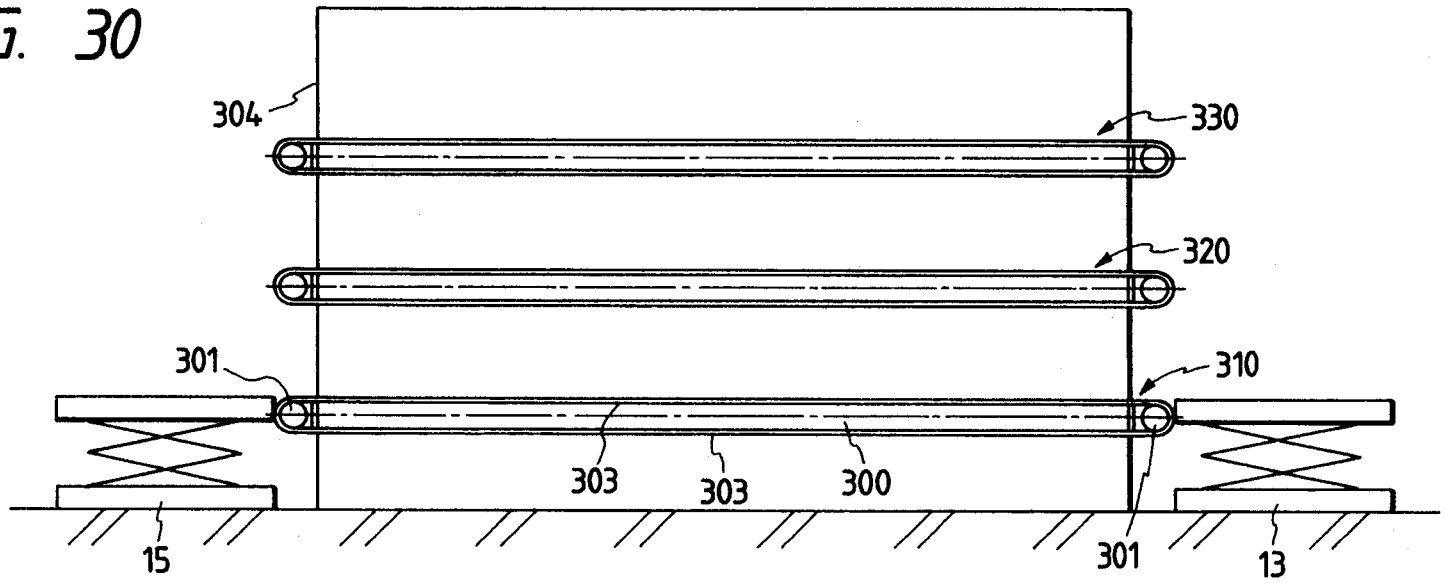
FIG. 30 is a sectional view taken along the line XXX—XXX in FIG. 29 and a view showing the outline of other units provided in the front and back of the apparatus according to the present invention.

FIG. 29 is a front view showing an example of the solid conveyer. FIG. 30 is a sectional view taken along the line XXX—XXX in FIG. 29. In FIGS. 29 and 30, the system for driving the belt conveyer is not shown. In the solid conveyer shown, belt conveyers 310, 320 and 330, each composed of an air table 300, rollers 301 and an endless belt 303 are provided in multi-stages at intervals of a sufficiently spaced distances to carry stacks. Each of the belt conveyers has a rectangular parallelepiped air table 300 provided with an air blowing hole at the upper surface thereof, freely rotable rollers 301, 301, provided at opposite ends of the air table, and an endless belt 303 laid over the air table 300 and the rollers 301. The endless belt 303 can be rotated or turned easily by a smaller amount of force.

Figure 31:
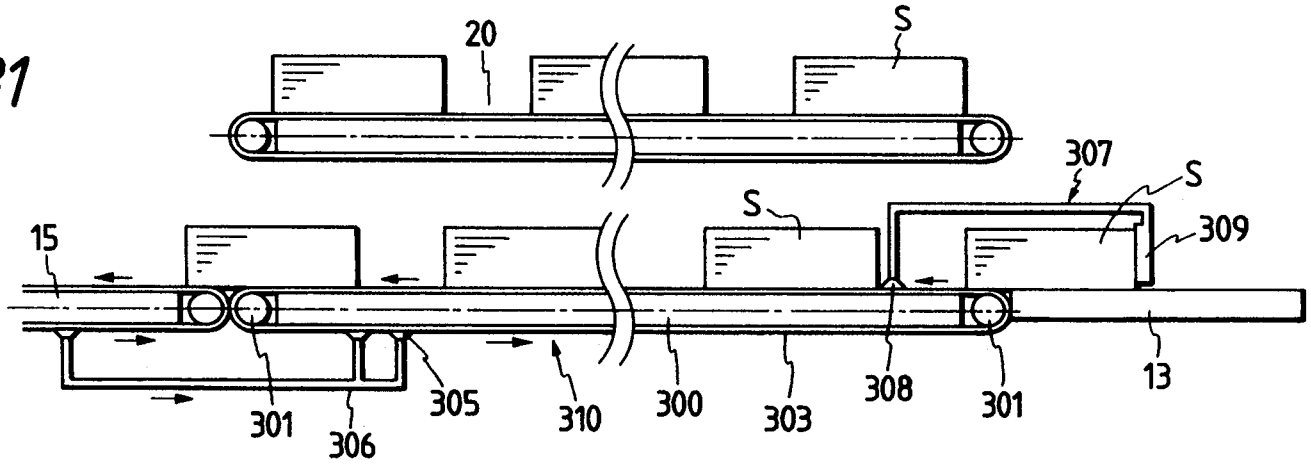
FIG. 31 is a view for explaining the driving of the belt conveyers in the solid conveyer in the present invention.
Figure 32:
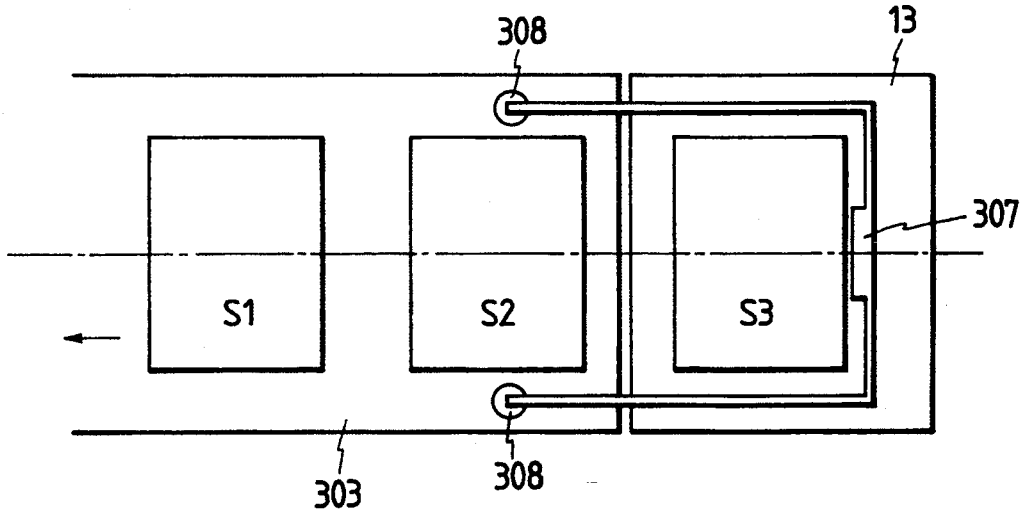
FIG. 32 is a view for explaining a method of transferring stacks to belt conveyers from another unit.
Figure 33:
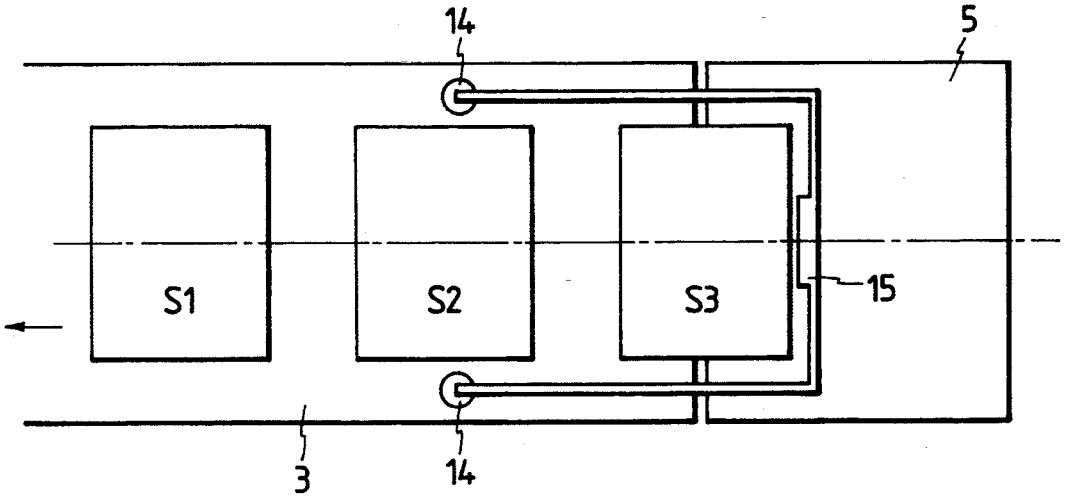
FIG. 33 is a view for explaining a method of transferring stacks to belt conveyers from another unit.

FIGS. 31 through 33 are views for explaining the method for driving belt conveyers, the method for transferring stacks to belt conveyers and the method for using the solid belt conveyer. FIG. 31 shows the condition in which a stack S is transferred to a belt conveyer 310 from another unit provided prior to the belt conveyer. The belt 303 is turned in the direction of the arrow by a belt driving means 306 having vacuum suction members 305. A stack transfer means 307 is composed of vacuum suction members 308 for engaging the belt 303, and a stack pusher 309. The vacuum suction members 308 receive driving force from the belt 303, so that the stack pusher 309, operating with the vacuum suction members 308, transfers the stack S from the inlet site elevator unit 13 onto the belt 303 while pushing the stack from the back. FIGS. 32 and 33 are views for explaining the change with the passage of time, of the state in which the stack S is transferred from the other unit 13 to the belt conveyer and conveyed. The stack transfer means 307 is mounted on the elevator unit 13 and movable vertically. In the transfer of the stack to the other belt conveyer 320, the stack transfer means 307 is moved back outward from between belt conveyers and then both the other elevator unit 13 and the stack transfer means are moved up.

The belt driving means 307, FIG. 31, mounted to another vertically movable unit 309, provided posterior to the solid conveyer serves to drive belts intermittently. In the driving of the other belt conveyer, the belt driving means 306 is moved back toward the other unit 15 side and then the position of a belt conveyer 15 to be driven is moved up and down by the other vertically movable unit 15. Then, the belt driving means 306 is brought to the position shown in FIG. 31, so that the belt conveyer is driven by moving the vacuum suction members 305 contacting the belt.

In the solid conveyer according to the present invention, in a period in which a stack S is transferred to a belt conveyer at one state, the other belt conveyer is stopping, perfectly while another stack is put thereon, or while the other belt conveyer is kept empty. That is, means operated are one stack transfer means 307 and one belt driving means 306 for the multi-stage belt conveyer. Furthermore, the two means make a pair for operating one belt conveyer.

Although the other units 13 and 15 are not limited specifically, this example shows the case where the other units 13 and 15 are an air table-including elevator and a vertically movable belt conveyer, respectively.

According to the present invention, not only a stack of cut sheets, or the like, can be carried without use of any special auxiliary device and without occurrence of breaking or wrinkling, but belt conveyers can be provided so multi-staged so that stacks can be stored on the belt conveyers, if necessary. Accordingly, the apparatus according to the present invention can serve also as a storehouse.

What is claimed is:

1. A method for automatically processing printed paper in a cut-sheet feed rotary printing press by a pair of successively operated receiving means, comprising the steps of:

receiving on said receiving means printed paper sheets discharged from printing units of said press at a paper discharge, one printed paper sheet on another until a predetermined number of printed sheets is received on each of said receiving means successively;

employing a first moving means to move said receiving means successively in a direction from said paper discharge to a position remote therefrom;

employing a second moving means to move said receiving means successively in a direction from said remote position to said paper discharge;

successively withdrawing said received printed paper from each of said receiving means at said remote position; and transferring said withdrawn printed sheets from said remote position to a further processing station for performance of a further processing step on said withdrawn printed sheets.

2. A method for automatically processing printed paper according to claim 1, wherein a printed paper outlet side of said further processing station after said printed paper is discharged from said further processing step is at a paper feeding side of said press.

3. A cut-sheet feed rotary press having an automatic printed paper processing apparatus, comprising:

a printing press body composed of a paper feeder, printing units, and a paper discharge;

a discharged paper transfer apparatus adjacent said paper discharge, said discharged paper transfer apparatus including a pair of receiving means successively operated to transfer paper beteween said paper discharge and a site remote therefrom for performance of a further processing step, first moving means operative to move each said receiving means successively from said paper discharge to said remote site, and second moving means operative to move each said receiving means successively from said remote site to said paper discharge; and a conveyor operative to convey printed paper from said discharged paper transfer apparatus.

4. A cut-sheet feed rotary press having an automatic paper processing apparatus according to claim 3, wherein said discharged paper transfer apparatus has a printed paper receiving means operative to repeatedly enter a position adjacent said paper discharge to receive a number of sheets of printed paper; means for withdrawing said printed paper sheets from said paper discharge; and means for transferring said printed paper sheets to said further processing step.

5. A cut-sheet feed rotary press having an automatic paper processing apparatus according to claim 4, wherein said printed paper receiving means for receiving said discharged paper includes:

a belt board composed of a board-shaped member, and a belt slidably stretched to cover a surface of said board-shaped member;

guide rails for guiding said belt board to a position where printed sheets are received; and a belt board moving means for moving said belt board along said guide rails.

6. A cut-sheet feed rotary press having an automatic paper processing apparatus according to claim 5, wherein said board-shaped member is an air table.

7. A cut-sheet feed rotary press having an automatic paper processing apparatus, comprising:

a printing press body including a paper feeder, printing units, and a paper discharge;

a discharged paper transfer apparatus adjacent said paper discharge;

a conveyor connected to said discharged paper transfer apparatus;

said discharged paper transfer apparatus including a printed paper receiving means which, when operatively positioned adjacent said paper discharge, has a printed paper receiving surface disposed substantially in a plane for receiving sheets of printed paper discharged from said paper discharge, said surface being formed to extend from one end of an area of operation to another end thereof; and means for bringing said receiving surface into contact with said discharged printed sheets at zero horizontal speed relative thereto, wherein said printed paper receiving means for receiving said discharged paper includes:

a belt board composed of a board-shaped member, and a belt slidably stretched to cover a surface of said board-shaped member;

guide rails for guiding said belt board to a position where printed sheets are received; and a belt board moving means for moving said belt board along said guide rails.

8. A cut-sheet feed rotary press having an automatic paper processing apparatus according to claim 7, wherein said board-shaped member is an air table.

9. A cut-sheet feed rotary press having an automatic printed paper processing apparatus comprising:

a printing press body including a paper feeder, printing units and a paper discharge;

a discharged paper transfer apparatus at said paper discharge;

a conveyor connected to said discharged paper transfer apparatus;

a board-shaped member;

freely rotatable rollers at opposite end portions of said board-shaped member;

a belt slidable stretched to cover said board-shaped member and said rollers; and a belt driving means having a suction member for moving said belt.

10. A cut-sheet feed rotary press having an automatic paper processing apparatus according to claim 9, wherein said board-shaped member is an air table.

11. A cut-sheet feed rotary press having an automatic paper processing apparatus, comprising:

a printing press body including a paper feeder, printing units, and a paper discharge;

a discharged paper transfer apparatus at said paper discharge;

a conveyor connected to said discharged paper transfer apparatus;

wherein said conveyor is a stationary conveyer having multiple stages of conveying means provided on a substantially fixed frame and each having a board-shaped member, rollers rotatably provided at opposite end portions of the board-shaped member, and a smooth-surface endless belt stretched to cover said board-shaped member and said rollers, said stationary conveyer being driven by means having suction means for moving said belts and driving said conveying means.

12. A out-sheet feed rotary press having an automatic paper processing apparatus according to claim 11, wherein said board-shaped member is an air table.

13. A cut-sheet feed rotary press having an automatic paper processing apparatus comprising:

a printing press body including a paper feeder, printing units, and a paper discharge;

a discharged paper transfer apparatus adjacent said paper discharge;

a conveyor connected to said discharged paper transfer apparatus;

wherein said conveyor includes two conveyer means arranged adjacent each other, two belts for driving said two conveyer means respectively, and a plurality of belt suction means for moving said belts and driving said conveyer means.

14. A cut-sheet feed rotary press having an automatic paper processing apparatus comprising:

a printing press body composed of a paper feeder, printing units, and a paper discharge;

a paper transfer apparatus at said paper discharge for receiving printed paper from said paper discharge and feeding said printed paper to said paper feeder;

a conveyer connected to said paper transfer apparatus for transferring said printed paper from said paper transfer apparatus toward said paper feeder;

said discharged paper transfer apparatus having a printed paper receiving means operative to repeatedly enter a position adjacent the paper discharge of the printing press body to receive a predetermined number of printed sheets, withdrawing said printed sheets from said paper discharge and transferring said printed sheets to a remote position for performance of a further processing step, wherein said printed paper receiving means for receiving said discharged paper includes:

a belt board composed of a board-shaped member, and a belt slidable stretched to cover a surface of said board-shaped member;

guide rails for guiding said belt board to a position in which printed sheets are received; and a belt board moving means for moving said belt board along said guide rails.

15. A cut-sheet feed rotary press having an automatic paper processing apparatus according to claim 14, wherein said board-shaped member is an air table.

16. A cut sheet-feed rotary press having an automatic paper processing apparatus according to claim 14, wherein said printed paper receiving means of said discharged paper transfer apparatus has a printed paper receiving surface substantially in a plane for receiving dropped printed sheets and formed to extend from one end of an area of operation to another end thereof, and means for moving said receiving surface into contact with said dropped printed sheets at zero horizontal speed relative to the dropped sheets.

17. A cut sheet-feed rotary press having an automatic paper processing apparatus comprising:

a printing press body including a paper feeder, printing units, and a paper discharge;

a paper transfer apparatus at said paper discharge for receiving printed paper from said paper discharge and feeding said printed paper to said paper feeder;

a conveyor connected to said paper transfer apparatus for transferring said printed paper from said paper transfer apparatus toward said paper feeder, wherein said paper transfer apparatus includes printed paper receiving means having a printed paper receiving surface temporarily disposed substantially on a plane for receiving dropped printed sheets and formed to extend from one end of an area of operation to another end thereof and means for moving said receiving surface into contact with said dropped printed sheets at zero horizontal speed relative to the dropped printed sheets, said printed paper receiving means including:

a belt board composed of a board-shaped member, and a belt slidably stretched to cover a surface of said board-shaped member;

guide rails for guiding said belt board to a position where printed sheets are received; and a belt board moving means for moving said belt board along said guide rails.

18. A cut-sheet feed rotary press having an automatic paper processing apparatus according to claim 17, wherein said board-shaped member is an air table.

19. A cut sheet-feed rotary press having an automatic paper processing apparatus comprising:

a printing press body composed of a paper feeder, printing units, and a paper discharge;

a paper transfer apparatus at said paper discharge for receiving printed paper from said paper discharge and feeding said printed paper to said paper feeder; and a conveyer connected to said paper transfer apparatus for transferring said printed paper from said paper transfer apparatus toward said paper feeder, wherein said conveyer includes:

a board-shaped member;

freely rotatable rollers at opposite end portions of said board-shaped member;

a belt slidably stretched to cover said board-shaped member and said rollers; and a belt driving means having a suction member for moving said belt.

20. A cut-sheet feed rotary press having an automatic paper processing apparatus according to claim 19, wherein said board-shaped member is an air table.

21. A cut sheet-feed rotary press having an automatic paper processing apparatus comprising:

a printing press body composed of a paper feeder, printing units, and a paper discharge;

a paper transfer apparatus at said paper discharge for receiving printed paper from said paper discharge and feeding said printed paper to said paper feeder; and a conveyer connected to said paper transfer apparatus for transferring said printed paper from said paper transfer apparatus toward said paper feeder, wherein said conveyer includes a stationary frame containing multiple stages of conveyer means provided on said frame and each having a board-shaped member, rollers rotatably provided at opposite end portions of the board-shaped member, a smooth-surface endless belt stretched to cover said board-shaped member and said rollers, and drive means having suction means for moving said belts and driving said conveyer means.

22. A cut-sheet feed rotary press having an automatic paper processing apparatus according to claim 21, wherein said board-shaped member is an air table.

23. A cut sheet-feed rotary press having an automatic paper processing apparatus comprising:

a printing press body composed of a paper feeder, printing units, and a paper discharge;

a paper transfer apparatus at said paper discharge for receiving printed paper from said paper discharge and feeding said printed paper to said paper feeder; and a conveyer connected to said paper transfer apparatus for transferring said printer paper from said paper transfer apparatus toward said paper feeder, wherein said conveyer includes two conveyer means arranged adjacent each other, two belts for driving said two conveyer means respectively, and a plurality of belt suction means for engaging said belts at the same time, said plurality of belt suction means being moved in parallel to belt surfaces of said two belts when said two belts are engaged by said plurality of belt suction means so that said two belts are turned at the same speed and over the same distance with each other.

* * * * *